US008272718B2

(12) United States Patent
Katoh et al.

(10) Patent No.: US 8,272,718 B2
(45) Date of Patent: Sep. 25, 2012

(54) IMAGE FORMING APPARATUS HAVING RECORDING HEAD

(75) Inventors: Tomomi Katoh, Ebina (JP); Kazuo Haida, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 343 days.

(21) Appl. No.: 12/709,946

(22) Filed: Feb. 22, 2010

(65) Prior Publication Data

US 2010/0214378 A1 Aug. 26, 2010

(30) Foreign Application Priority Data

Feb. 26, 2009 (JP) ..... 2009-044850

(51) Int. Cl.
*B41J 2/175* (2006.01)
*B41J 29/38* (2006.01)
*B41J 2/17* (2006.01)

(52) U.S. Cl. ..... 347/85; 347/6; 347/17; 347/84

(58) Field of Classification Search ..... 347/6, 17, 347/84, 85
See application file for complete search history.

(56) References Cited

U.S. PATENT DOCUMENTS

| | | | | |
|---|---|---|---|---|
| 6,682,185 | B2 | 1/2004 | Hashimoto et al. | |
| 6,913,348 | B2 | 7/2005 | Hashimoto et al. | |
| 7,325,908 | B2 | 2/2008 | Katoh et al. | |
| 7,364,253 | B2 | 4/2008 | Hashimoto et al. | |
| 8,186,819 | B2 * | 5/2012 | Kaiho | 347/85 |
| 2006/0209140 | A1 * | 9/2006 | Nagai | 347/85 |
| 2007/0008356 | A1 | 1/2007 | Katoh | |
| 2008/0158294 | A1 | 7/2008 | Katoh | |
| 2009/0002467 | A1 * | 1/2009 | Watanabe | 347/89 |
| 2009/0051724 | A1 | 2/2009 | Katoh | |
| 2009/0290002 | A1 | 11/2009 | Katoh | |

FOREIGN PATENT DOCUMENTS

| | | |
|---|---|---|
| JP | 5-504308 | 7/1993 |
| JP | 3606282 | 10/2004 |
| JP | 2004-351845 | 12/2004 |
| JP | 2005-342960 | 12/2005 |
| WO | WO91/08903 | 6/1991 |
| WO | WO03/041964 | 5/2003 |

* cited by examiner

*Primary Examiner* — Matthew Luu
*Assistant Examiner* — Jannelle M Lebron
(74) *Attorney, Agent, or Firm* — Cooper & Dunham LLP

(57) ABSTRACT

An image forming apparatus includes a recording head having nozzles for ejecting droplets, a liquid tank that stores liquid to be supplied to the recording head, a first channel member connected to the recording head, a second channel member connected to the liquid tank, a pressure regulation valve including an internal channel that connects the first channel member to the second channel member, a third channel member connecting the pressure regulation valve to one of the second channel member and the liquid tank, and a liquid feed unit disposed on the third channel member to feed the liquid. The pressure regulation valve changes a fluid resistance of the internal channel of the pressure regulation valve in response to a flow amount of the liquid passing through the first channel member and, as liquid droplets are ejected from the nozzles, the liquid feed unit feeds the liquid from the liquid tank to the recording head with the recording head in communication with the liquid tank via the pressure regulation valve.

16 Claims, 18 Drawing Sheets

IMAGE FORMING APPARATUS HAVING RECORDING HEAD

BACKGROUND OF THE INVENTION

1. Field of the Invention

Illustrative embodiments of the present invention relate to an image forming apparatus, and more specifically, to an image forming apparatus having a recording head that ejects droplets.

2. Description of the Background

Image forming apparatuses are used as printers, facsimile machines, copiers, plotters, or multi-functional peripherals having two or more of the foregoing capabilities. As one type of image forming apparatus employing a liquid-ejection recording method, an inkjet recording apparatus is known that ejects liquid droplets from a recording head onto a recording medium to form a desired image (hereinafter "image formation" is used as a synonym for "image recording" and "image printing").

Such inkjet-type image forming apparatuses fall into two main types: a serial-type image forming apparatus that forms an image by ejecting droplets from the recording head while moving the recording head in a main scan direction, and a line-head-type image forming apparatus that forms an image by ejecting droplets from a linear-shaped recording head held stationary in the image forming apparatus.

As for the recording heads (droplet ejection heads) used in these inkjet-type image forming apparatuses, several different types are known. One example is a piezoelectric recording head that ejects liquid droplets by displacing a diaphragm using a piezoelectric actuator or the like. Specifically, when the piezoelectric actuator displaces the diaphragm, the volume of a chamber containing the liquid is changed. As a result, the internal pressure of the chamber is increased, so that droplets are ejected from the head. Another example is a thermal recording head that ejects droplets by increasing the internal pressure of the chamber using a heater. This increase is accomplished, for example, using a heater located in the chamber that is heated by an electric current to generate bubbles in the chamber. As a result, the internal pressure of the chamber is increased, so that droplets are ejected from the head.

For such a liquid-ejection type image forming apparatus, there is demand for enhancing throughput, i.e., speed of image formation. For example, one liquid (in this case ink) supply method is proposed in which ink is supplied from a high-capacity ink cartridge (main tank) mounted in the image forming apparatus to a sub tank (also referred to as a head tank or buffer tank) mounted in an upper portion of the recording head through a tube. Such a tube supply method allows the weight and size of a carriage of the recording head to be reduced and enables downsizing of the structure, driving system, and image forming apparatus as a whole.

In this regard, in the tube supply method described above, ink is supplied from the ink cartridge to the recording head and consumed at the recording head during image formation. If, for example, a flexible thin tube is used, a relatively large fluid resistance arises when ink passes through the tube. Consequently, ink may not be supplied in time for ink ejection, thus causing ejection failure. In particular, as the size of the image forming apparatus increases, the length of the tube also increases, thus causing a larger resistance to ink passing through the tube. Alternatively, when high speed printing is performed or high viscosity ink is employed, such fluid resistance of the tube is increased, thus causing ink supply shortage.

Hence, one conventional technique is proposed in which ink in the ink cartridge is maintained in a pressurized state and a differential-pressure regulation valve is provided at an upstream side of the recording head in a direction in which ink is supplied (hereinafter, "ink supply direction"). In such a configuration, when negative pressure within the sub tank is greater than a predetermined pressure value, ink is supplied to the recording head.

However, for the conventional technique described above, although the above-described ink supply shortage is prevented, the mechanism for controlling negative pressure is complicated and a high level of sealing performance is required for a negative-pressure conjunction valve. Further, as constant pressurization is employed, a high level of air sealing is required for all connecting portions of the ink supply paths. Accordingly, a failure in any part of the sealing of the ink supply system might cause the ink to blow out.

In another conventional technique, a negative-pressure chamber maintained in a negatively pressurized state using a spring is provided at an upstream side of the recording head. In this configuration, ink supply pressure is actively controlled by feeding ink to the negative-pressure chamber using a pump. In still another conventional technique, the ink supply pressure is actively controlled using a pump without such a negative-pressure room.

In the above-described two techniques, when the ink supply pressure is actively controlled, the amount of ink fed using the pump is accurately controlled in response to the consumption amount of ink or the like. Further, when the above-described techniques are applied to an image forming apparatus using different color inks, the pump is separately controlled for each of the respective color inks. Such a configuration may require a complex control system and an increased size of the image forming apparatus.

One method of obtaining a negative pressure with a simple configuration is proposed in which an ink cartridge to the atmosphere is connected to a recording head through a tube and the ink cartridge is located at a position lower than the recording head to obtain a negative pressure using a difference in fluid level between fluid heads.

Such a fluid-level difference method can provide stable negative pressure using a very simple configuration as compared to the method of constantly applying pressure using a negative-pressure conjunction valve or the method of feeding ink using a negative-pressure chamber and a pump. However, in the fluid-level difference method, the above-described large tube resistance may cause pressure loss.

One conventional technique proposed to prevent such pressure loss in the ink supply system obtains a negative pressure using the fluid-level difference method, this time with a pump that is provided on a tube connecting the recording head to the ink cartridge. Further, a bypass is provided to connect an upstream side and a downstream side of the pump, and a valve is provided on the bypass. The degree of opening of the valve on the bypass is adjusted in response to printing process to maintain a desired pressure.

However, when the above-described conventional technique is applied to an image forming apparatus using different color inks, the pump must be separately controlled for respective color inks, resulting in an increased size of the image forming apparatus.

SUMMARY OF THE INVENTION

In one illustrative embodiment, an image forming apparatus includes a recording head having nozzles for ejecting droplets, a liquid tank that stores liquid to be supplied to the recording head, a first channel member connected to the recording head, a second channel member connected to the liquid tank, a pressure regulation valve including an internal channel that connects the first channel member to the second channel member, a third channel member connecting the pressure regulation valve to one of the second channel member and the liquid tank, and a liquid feed unit disposed on the third channel member to feed the liquid. The pressure regulation valve changes a fluid resistance of the internal channel of the pressure regulation valve in response to a flow amount of the liquid passing through the first channel member and, as liquid droplets are ejected from the nozzles, the liquid feed unit feeds the liquid from the liquid tank to the recording head with the recording head in communication with the liquid tank via the pressure regulation valve.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
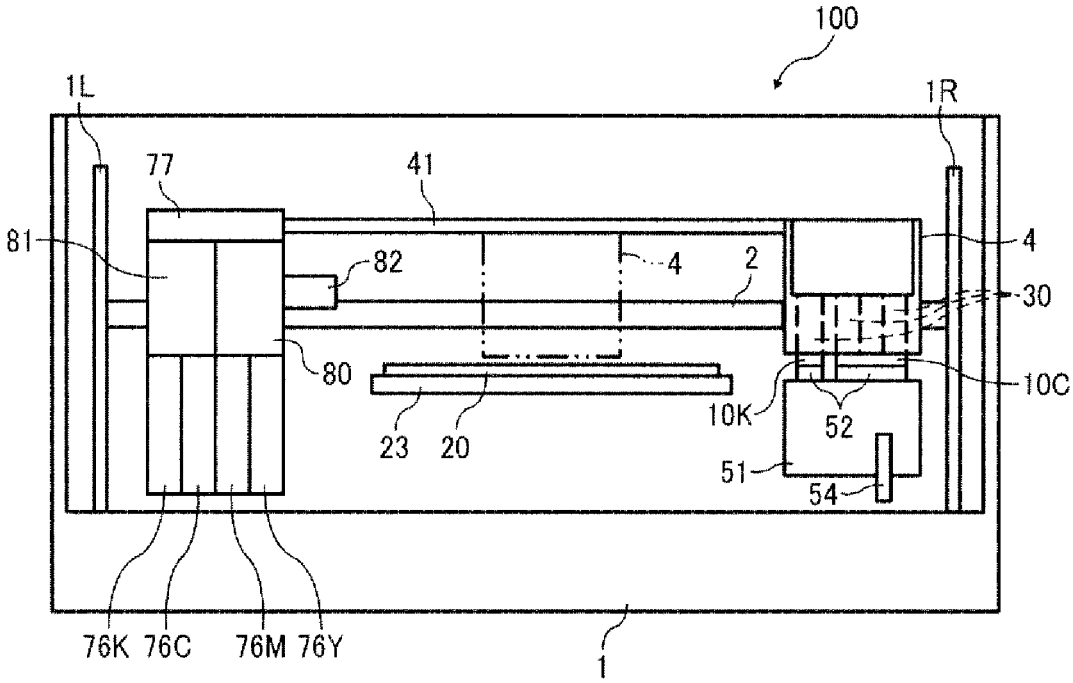
FIG. 1 is a perspective view illustrating an example of an inkjet recording apparatus according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation" used herein includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present disclosure are described with reference to attached drawings.

Figure 2:
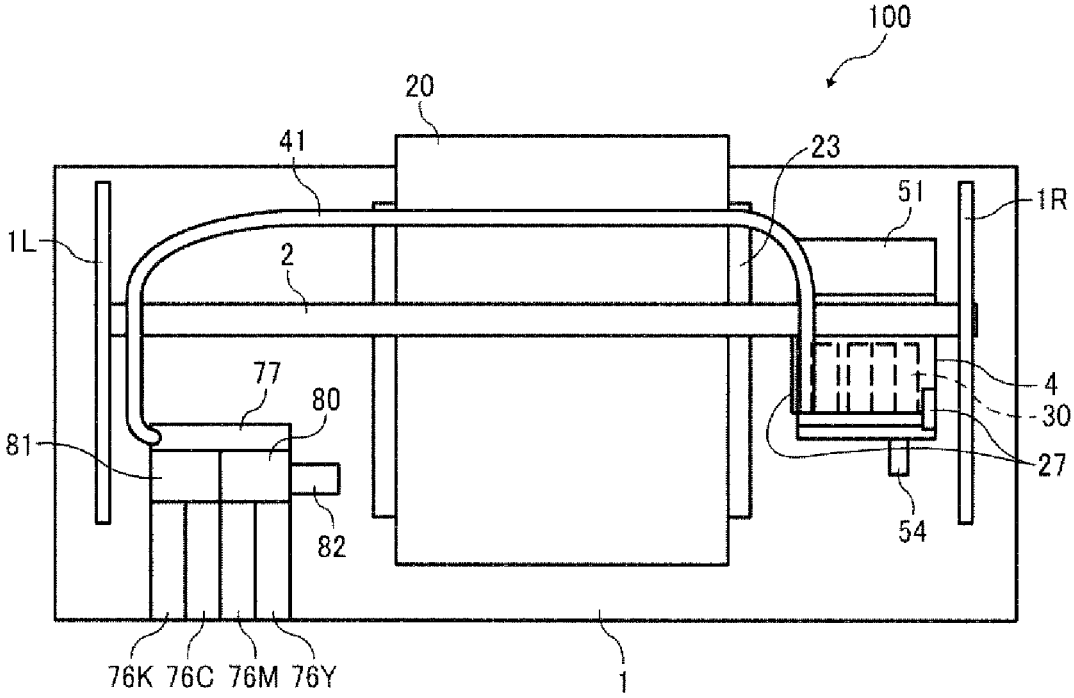
FIG. 2 is a schematic plan view illustrating the inkjet recording apparatus illustrated in FIG. 1.
Figure 3:
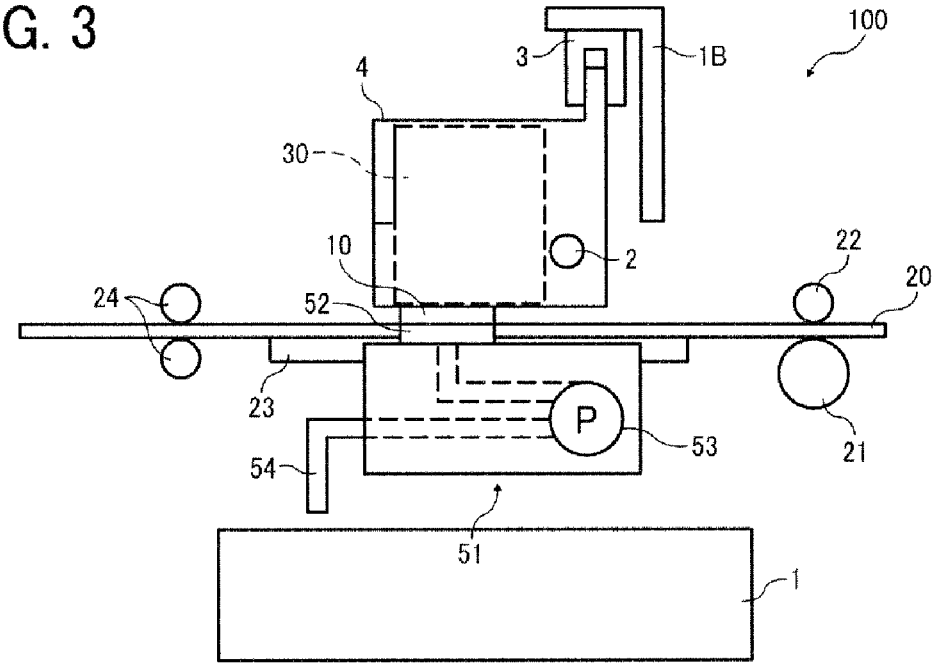
FIG. 3 is a schematic side view illustrating the inkjet recording apparatus illustrated in FIG. 1.

First, as one example of an image forming apparatus according to an illustrative embodiment of the present disclosure, an inkjet recording apparatus 100 is described with reference to FIGS. 1 to 3. FIG. 1 is a schematic front view illustrating a configuration of the inkjet recording apparatus 100. FIG. 2 is a schematic plan view illustrating the inkjet recording apparatus 100. FIG. 3 is a side view illustrating the inkjet recording apparatus 100.

The inkjet recording apparatus 100 includes a body frame 1, left and right side plates 1L and 1R mounted on the body frame 1, a rear frame 1B laterally bridged over the body frame 1, a guide rod 2 serving as a guide member extended between the side plates 1L and 1R, a guide rail 3 mounted on the rear frame 1B, and a carriage 4 supported with the guide rod 2 and the guide rail 3 so as to be slidable in a main scan direction, i.e., a long direction of the guide rod 2. The carriage 4 is moved using a main scan motor and a timing belt to scan in the main scan direction.

As illustrated in FIG. 1, for example, a recording head 10K that ejects ink droplets of black (K) and a recording head 10C that ejects ink droplets of cyan (C), magenta (M), and yellow (Y) are mounted on the carriage 4. Each of the recording heads 10 has a plurality of ink ejection openings (nozzles) arranged perpendicular to the main scan direction, and are mounted on the carriage 4 so as to eject ink droplets downward from the nozzles. The recording head 10C has at least three rows of nozzles from which ink droplets of C, M, and Y are independently ejected. Hereinafter, the recording head 10K and the respective nozzle rows of the recording head 10C corresponding to C, M, and Y are collectively referred to a "recording head 10" unless specifically distinguished.

Figure 4:
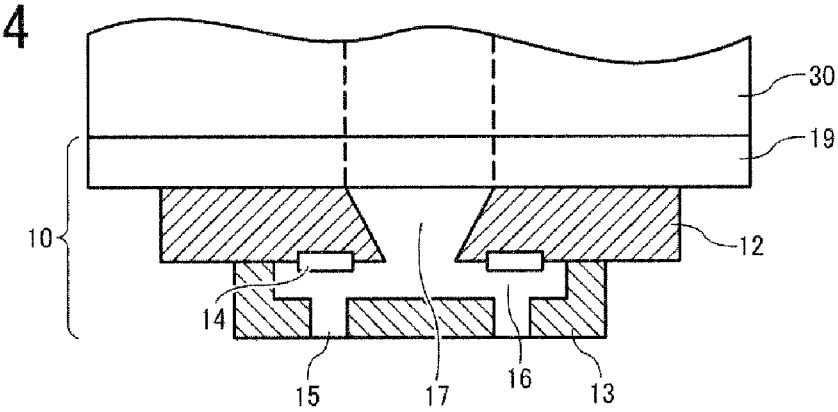
FIG. 4 is an enlarged view illustrating a recording head of the inkjet recording apparatus illustrated in FIG. 1.

As illustrated in FIG. 4, the recording head 10 includes a heating plate 12 and a chamber formation member 13 and ejects, in droplet form, ink sequentially supplied from a channel formed in a head base 19 to a common channel 17 and a chamber (separate channel) 16. The recording head 10 employs a thermal method in which a heater 14 is driven to cause film boiling in ink to obtain ejection pressure and a side shooter configuration in which the direction in which ink flows toward an ejection-energy acting portion (heater section) of the chamber 16 is perpendicular to the central axis of a nozzle 15.

Alternatively, any suitable method such as a method in which a diaphragm is deformed using a piezoelectric element or electrostatic force to obtain ejection pressure may be employed in the recording head of the image forming apparatus.

Further, it is conceivable that the thermal-type recording head employs an edge shooter configuration in which the ink ejection direction differs from that of the side shooter configuration. The edge shooter configuration may be suffered from a so-called cavitation phenomenon in which the bursting impact of bubbles gradually damages the heater 14. By contrast, in the above-described side shooter configuration, when bubbles grow up and reach the nozzle 15, the bubbles are released to the atmosphere, thus preventing the bubbles from shrinking due to temperature decrease. Accordingly, the side shooter configuration is advantageous in the length of product life over the edge shooter configuration. The side shooter configuration also has structural advantages over the edge shooter configuration in that heat energy from the heater 14 is more effectively converted to kinetic energy to form and jet ink droplets and the restoration speed of meniscus by ink supply is faster. For these reasons, the recording head having the side shooter configuration is employed in the inkjet recording apparatus 100.

Below the carriage 4, a sheet 20 on which an image is formed using the recording head 10 is conveyed in a direction (hereinafter a "sub-scan direction") perpendicular to the main scan direction. As illustrated in FIG. 3, the sheet 20 is sandwiched with a conveyance roller 21 and a pressing roller 22 and conveyed to an image formation area (printing area) in which an image is formed using the recording head 10. The sheet 20 is further conveyed over a printing guide member 23 and fed using a pair of output rollers 24 in a sheet output direction.

At this time, the scanning of the carriage 4 in the main scan direction is synchronized with the ejection of ink from the recording head 10 at a proper timing in accordance with image data to form a first band of a target image on the sheet 20. After the first band of the image has been formed, the sheet 20 is fed by a certain distance in the sub-scan direction and the recording head 10 forms a second band of the image on the sheet 20. By repeating such operations, the whole image is formed on the sheet 20.

On top of the recording head 10 is integrally connected a sub tank (buffer tank or head tank) 30 including an ink chamber that temporarily stores ink. The term "integrally" used herein includes that the recording head 10 is connected to the sub tank 30 using a tube(s) or pipe(s) and both the recording head 10 and the sub tank 30 are mounted on the carriage 4.

Respective color inks are supplied from ink cartridges (main tanks) 76 serving as liquid tanks that store respective color inks to the sub tanks 30 via a liquid supply tube 41. The ink cartridges (main tanks) 76 are detachably mounted on a cartridge holder 77 at one end of the inkjet recording apparatus 100 in the main scan direction. The liquid supply tube 41 serving as a first channel member is a tube member that forms part of the ink supply path of the inkjet recording apparatus 100.

On the other end of the inkjet recording apparatus 100 in the main scan direction is disposed a maintenance-and-recovery unit 51 that maintains and recovers conditions of the recording head 10. The maintenance-and-recovery unit 51 includes a cap 52 that seals a nozzle surface of the recording head 10 and a suction pump 53 that suctions the cap 52, and a drain path 54 from which waste ink suctioned with the suction pump 53 is drained. The waste ink is discharged from the drain path 54 to a waste tank, not illustrated, which mounted on the body frame 1.

Figure 5:
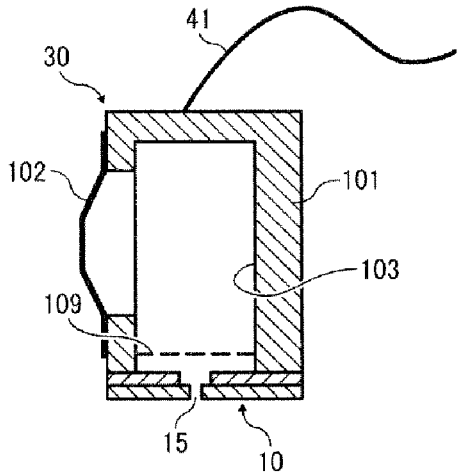
FIG. 5 is a schematic cross-section view illustrating a configuration of a sub tank.
Figure 6:
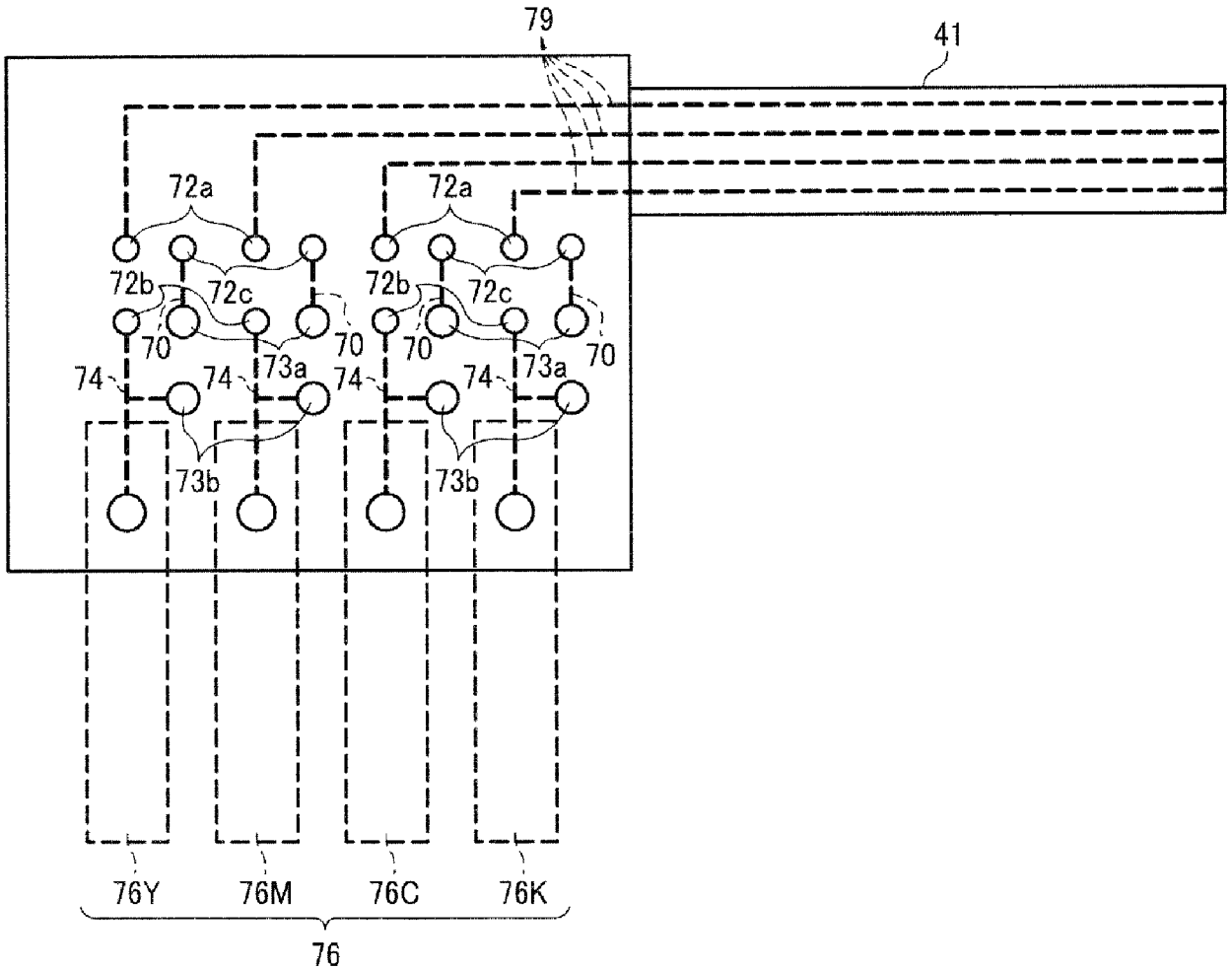
FIG. 6 is a schematic view illustrating a configuration of a cartridge holder.
Figure 7:
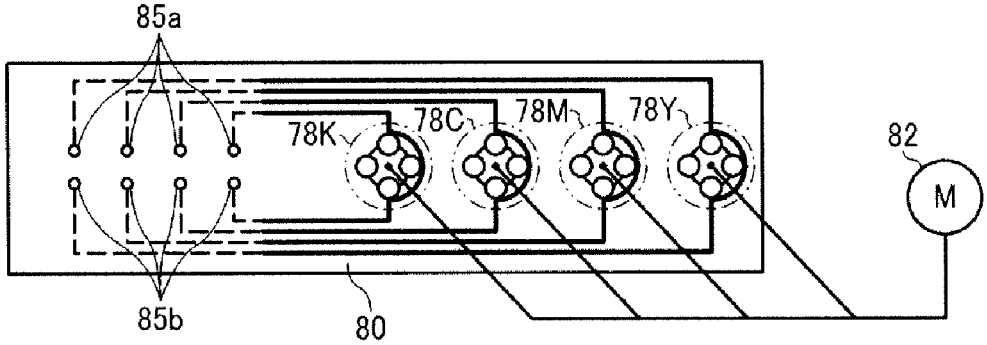
FIG. 7 is a schematic view illustrating a configuration of a pump unit.
Figure 8:
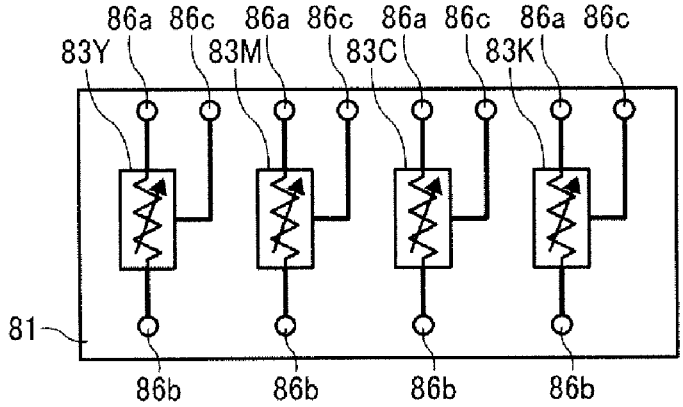
FIG. 8 is a schematic view illustrating a configuration of a pressure regulation unit.
Figure 9:
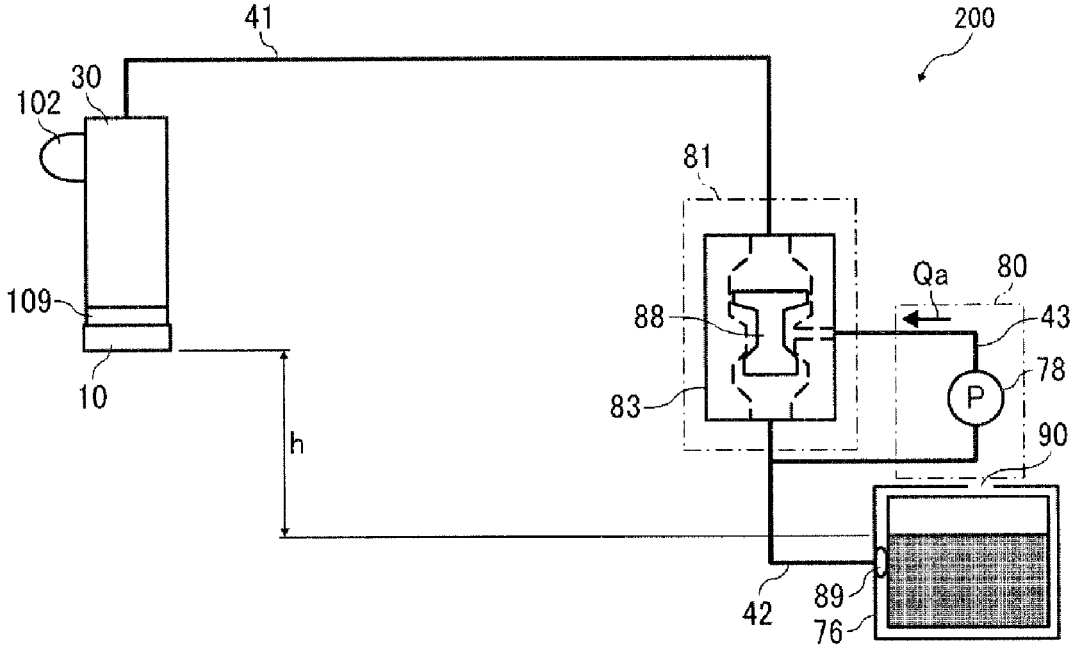
FIG. 9 is a schematic view illustrating an ink supply system according to a first illustrative embodiment according to the present disclosure.
Figure 10A:
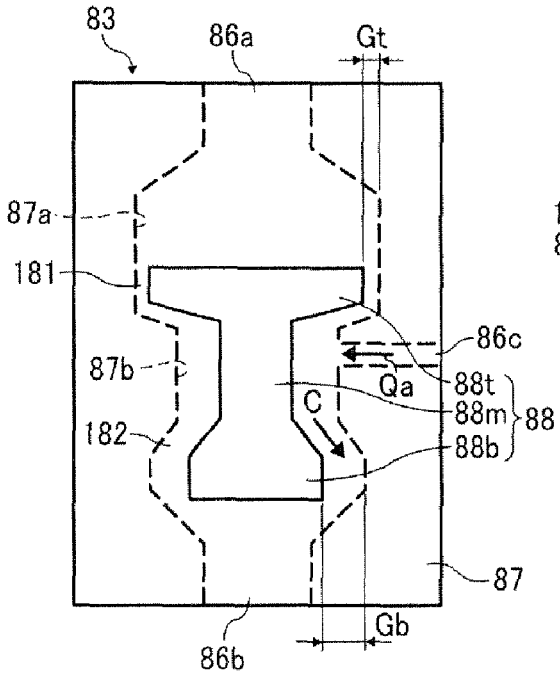
FIGS. 10A and 10B are schematic views illustrating a channel-resistance adjustment unit of the ink supply system illustrated in FIG. 9.
Figure 10B:
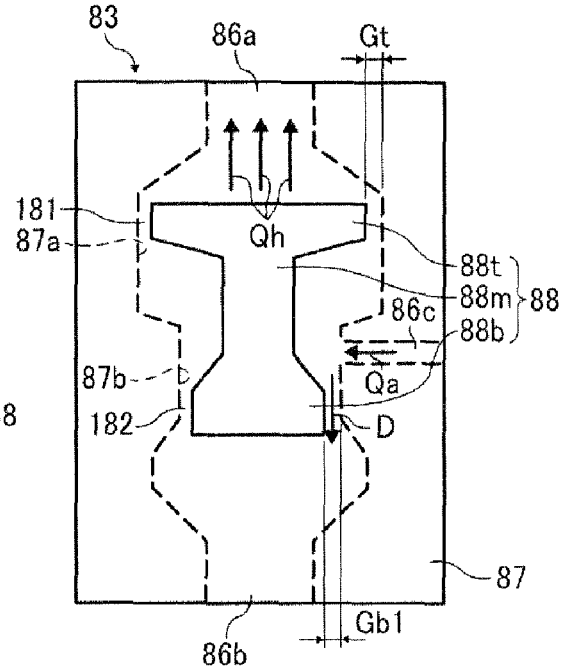

Next, a configuration of an ink supply system 200 of the inkjet recording apparatus 100 is described with reference to FIGS. 5 to 10. FIG. 5 is a schematic cross-section view of the sub tank 30 of the ink supply system 200. FIG. 6 is a schematic view illustrating a configuration of the cartridge holder 77. FIG. 7 is a schematic view illustrating a configuration of a pump unit 80. FIG. 8 is a schematic view illustrating a configuration of a pressure regulation unit 81. FIG. 9 is a schematic view illustrating an ink supply system 200 according to a first illustrative embodiment according to the present disclosure. FIGS. 10A and 10B are schematic views illustrating an example of a channel-resistance adjustment unit 83.

On the sub tank 30 is mounted a flexible rubber member 102 convexly protruding outward at an opening portion of a tank case 101 forming an ink chamber 103. Within the ink chamber 103, a filter 109 that filters ink to remove dust or foreign substance is disposed near a joint portion of the recording head 10. With such a configuration, after foreign substance is removed, ink is supplied to the recording head 10.

To the sub tank 30 is connected one end of the liquid supply tube 41. As illustrated in FIGS. 1 and 2, the other end of the liquid supply tube 40 is connected to the cartridge holder 77 that is mounted in the inkjet recording apparatus 100.

To the cartridge holder 77 is connected the ink cartridges 76, the pump unit 80 serving as a liquid feed unit, and the pressure regulation unit 81.

As illustrated in FIG. 6, within the cartridge holder 77 are provided internal channels 70, branch channels 74, and channels 79 corresponding to the different color inks. The cartridge holder 77 also includes pump connection ports 73*a* and 73*b* connected to the pump unit 80 and pressure regulation ports 72*a*, 72*b*, and 72*c* connected to the pressure regulation unit 81. The pump connection ports 73*a* are connected to the pressure regulation ports 72*c* via the internal channels 70.

As illustrated in FIG. 7, the pump unit 80 includes ports 85*a* and 85*b* connected to the pump connection ports 73*a* and 73*b*, respectively, and pumps 78 connected to the ports 85*a* and 85*b*. The pumps 78 may be, for example, tubing pumps, diaphragm pumps, gear pumps, or any other suitable type of pumps. In the pump unit 80 illustrated in FIG. 7, the four pumps 78K, 78C, 78M, and 78Y are provided corresponding to four ink colors and driven in conjunction with each other using the motor 82.

As illustrated in FIG. 8, the pressure regulation unit 81 includes ports 86*a*, 86*b*, and 86*c* connected to the pressure regulation ports 72*a*, 72*b*, and 72*c*, respectively, and channel-resistance adjustment units 83K, 83C, 83M, and 83Y serving as pressure regulation valves connected to the ports 86*a*, 86*b*, and 86*c*.

Next, entire configuration and operation of the ink supply system 200 is described with reference to FIG. 9.

FIG. 9 is a schematic view illustrating a configuration of the ink supply system 200 according to the present illustrative embodiment. In FIG. 9, components connected to one of the recording heads (liquid ejection heads) 10 are illustrated in a simplified manner.

The ink supply system 200 includes the ink cartridge 76 to store ink supplied to the recording head 10, the liquid supply tube 41 serving as the first channel member to supply ink to the recording head 10, a second channel member 42 connected to the ink cartridge 76, the channel-resistance adjustment unit 83 serving as a pressure regulation valve that connects the liquid supply tube 41 (the first channel member) to the second channel member 42, a third channel member 43 that connects the second channel member 42 to the pressure regulation unit 81, and the pump 78 serving as a liquid feed unit provided at the third channel member 43.

The channel-resistance adjustment unit 83 has an internal channel, and the resistance of the internal channel varies depending on the flow direction and amount of liquid passing through the internal channel. For example, as illustrated in FIGS. 10A and 10B, the channel-resistance adjustment unit 83 includes a pipe member 87 that is a channel formation member to form the internal channel and a valve member 88 that is a movable member movably housed in a free state in the pipe member 87.

The pipe member 87 includes the port 86*a* connected to the liquid supply tube 41 serving as the first channel member, the port 86*b* connected to the second channel member 42, and the port 86*c* connected to the third channel member 43. The valve member 88 is an axial member with a plurality of steps of different diameters in a liquid flow direction. As illustrated in FIG. 9, for example, the valve member 88 has at least three step portions, such as a top portion 88*t*, a middle portion 88*m*, and a bottom portion 88*b*, of different diameters in the liquid flow direction, and the diameter of the middle portion 88*m* is formed smaller than the diameter of the bottom portion 88*b*. The valve member 88 is movable within the pipe member 87 and takes positions, such as a first position illustrated in FIG. 10A, a second position illustrated in FIG. 10B, and a third position between the first and second positions depending on the state in which liquid flows through the internal channel.

At the first channel 41 side of the channel-resistance changing unit 83, a first regulating portion 181 is formed between the top portion 88*t* of the valve member 88 and a channel portion 87*a* of the pipe member 87. At the second channel member 42 side of the channel-resistance changing unit 83, a second regulating portion 182 is formed between the bottom portion 88*b* of the valve member 88 and a channel portion 87*b* of the pipe member 87. As described above, the valve member 88 moves in response to the internal liquid flow of the channel-resistance changing unit 83 so as to change the regulation amount of the second regulating portion 182.

The pipe member 87 has the port 86*c* that forms part of the third channel member 43 at a position corresponding to the middle portion 88*m* of the valve member 88, that is, between the first regulating portion 181 and the second regulating portion 182.

As illustrated in FIG. 9, the ink cartridge 76 has an atmosphere communicating portion 90 and is disposed at a position at which the liquid level in the ink cartridge 76 is lower than the nozzle face of the recording head 10. Thus, when all of the ink supply channels are filled with ink, the recording head 10 is maintained at a negative pressure by a liquid-level difference "h" between the recording head 10 and the ink cartridge 76, thus allowing stable ejection of ink droplets from the recording head 10.

As described above, the fluid resistance of ink supply channels might prevent proper ink supply, for example, when the viscosity of ink ejected is high, the fluid resistance of the liquid supply tube 41 is high, the liquid supply tube 41 is relatively thin or long, or the ejection flow amount of ink is large. For example, it is conceivable that components, such as the liquid supply tube 41, the filter 109, and the joint 89, cause high resistance against ink supply of the ink supply system 200 (see FIG. 9).

When the inkjet recording apparatus 100 employs, e.g., a long tube of a 2.8 mm diameter and a 2,500 mm length as the liquid supply tube 41 and ejects high viscosity ink of 16 cP, the fluid resistance of the liquid supply tube 41 becomes 2.7e10 [Pa·s/m$^3$]. In the present illustrative embodiment, the fluid resistances of the filter 109 and the joint 89 are assumed to be, for example, 1e10 [Pa·s/m$^3$] and 2e9 [Pa·s/m$^3$].

In this configuration, for example, when the limit value of pressure loss at which the ink ejection of the recording head 10 is stably performed is set to 2.5 kPa, sequential ink ejection from all nozzles results in an ejection flow amount of 0.1 cc/s. At that time, the pressure loss becomes, for example, 6.9 kPa. Since the pressure loss is 3.94 kPa even without the pressure regulation unit 81, only using liquid-level difference in such a simple manner does not allow automatic ink supply in the ink supply system 200.

As described above, when the fluid resistance of the ink supply system 200 increases the pressure loss and causes shortage of the refill amount of ink, the pump 78 is driven to feed ink from the third channel member 43 in a direction indicated by an arrow "Qa" illustrated in FIG. 9. The term Qa represents assistive flow amount or assistive liquid flow and is also used as a code indicating the arrow. Thus, feeding ink with the pump 78 allows complementing the ink supply shortage (refill assistance).

Figure 11:
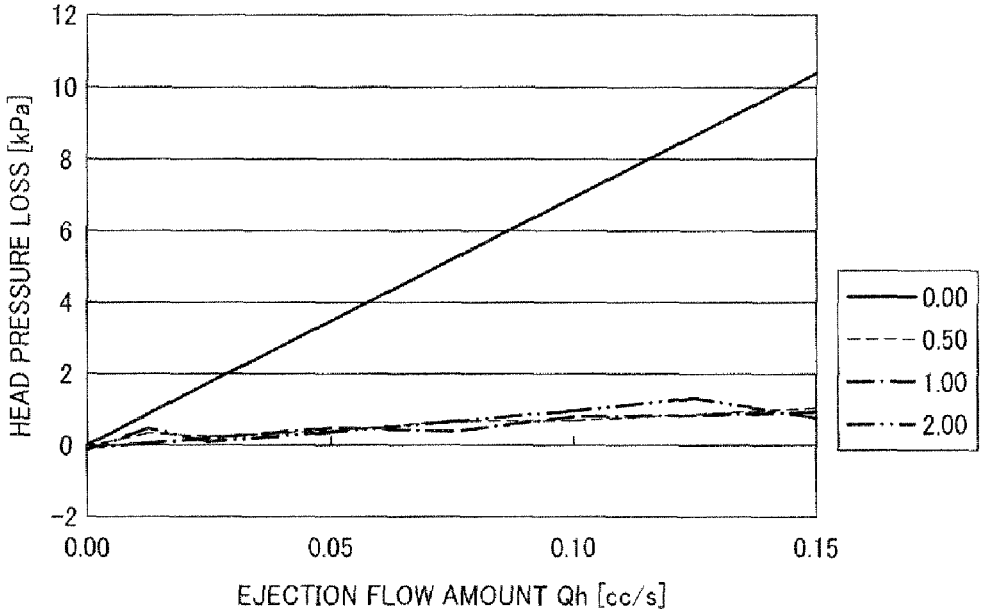
FIG. 11 is a graph showing an example of relation among head-ejection flow amount, head pressure loss, and assistive flow amount.

An example of the relation among the ejection flow amount of the recording head 10, the feed amount (assistive flow amount) of the pump 78, and the pressure of the recording head 10 is illustrated in FIG. 11. FIG. 11 shows a change in pressure loss of the ink supply system 200 with respect to the ejection flow amount of the recording head 10 when the assistive flow amount is 0 to 2 cc/s. As described above, when the assistive flow amount is zero, the pressure loss of the recording head 10 becomes approximately 7 kPa. Consequently, ink is not continuously ejected from the recording head 10, thus causing ejection failure. Hence, in the present illustrative embodiment, the pump 78 assists ink supply to reduce the pressure loss to approximately 1 kPa or lower, thus allowing continuous ejection.

Here, the ink supply assistance of the ink supply system 200 is described with reference to FIGS. 10A and 10B.

FIG. 10A shows a state of the channel-resistance adjustment unit 83 when droplet ejection from the recording head 10 is not performed or the ejection flow amount is low. In such a state, the valve member 88 is at a position closer to the port 86*b*. As illustrated in FIG. 10A, a gap Gb between the pipe member 87 and the bottom portion 88*b* of the valve member 88 is greater than a gap Gt between the pipe member 87 and the top portion 88*t* of the valve member 88. Further, as illustrated in FIG. 9, the liquid supply tube 41 and the filter 109 having high fluid resistance are located ahead of the port 86*a*. Accordingly, ink fed with the pump 78 in the direction indicated by the arrow "Qa" is likely to flow toward the port 86*b* (in a direction indicated by an arrow "C"). Accordingly, the ink flow created with the pump 78 causes ink circulation in a looped channel formed by the pump unit 80 and the channel-resistance adjustment unit 83.

FIG. 10B shows another state of the channel-resistance adjustment unit 83 when the ejection flow amount of the recording head 10 is large. As illustrated in FIG. 10B, the gap Gt between the pipe member 87 and the top portion 88*t* of the valve member 88 is set narrow. In such a configuration, when ink flow indicated by an arrow "Qh" is created by droplet ejection from the recording head 10, the valve member 88 is drawn by the ink flow to move toward the port 86*a* (in an upward direction in FIG. 10B). Thus, the bottom portion 88*b* of the valve member 88 moves to the small-diameter portion (the channel portion 87*b* or the second regulating portion 182), and a gap Gb1 between the pipe member 87 and the bottom portion 88*b* of the valve member 88 is relatively small. Ink fed in the direction indicated by the arrow "Qa" with the pump 78 flows through the narrow gap Gb1 (in a direction indicated by an arrow "D"), thus creating pressure. Such pressure reduces the pressure loss caused when ink flows into the recording head 10, thus allowing supplying a great amount of ink.

In the channel-resistance adjustment unit 83, when an increased ejection flow amount of the recording head 10 increases pressure loss, the opposing length (the length of the second regulating portion 182) in which the circumference surface of the bottom portion 88*b* of the valve member 88 and the channel portion 87*b* of the pipe member 87 faces each other along the ink flow direction is increased. As a result, the length of the narrow gap Gb1 between the bottom portion 88*b* of the valve member 88 and the pipe member 87 is increased, thus enhancing the pressure increasing effect of the pump (assisting pump) 78. Such a configuration allows automatic, stable ink supply in a simple manner without performing complicated control of a flow-amount regulation valve as conventionally performed.

Since the inkjet recording apparatus 100 according to the present illustrative embodiment ejects four types of color inks from the recording head 10, the ink supply system 200 having the configuration illustrated in FIG. 9 is provided for each color. In this case, an actuator such as a motor may be separately provided for each of the pumps 78 of four colors. Alternatively, as illustrated in FIG. 7, one common motor (actuator) 82 may be provided for the pumps 78 (78K, 78C, 78M, 78Y) of four colors.

When ink droplets of a plurality of colors are ejected to form an image, the amounts of ink ejected from the respective recording heads 10 vary. For example, one recording head 10 may eject ink from all nozzles while another recording head 10 does not eject ink from any nozzles. In such a case, in the ink supply system 200, the fluid resistance of the channel-resistance adjustment unit 83 automatically changes depending on the ejection flow amount. Such a configuration allows obviating active control of the pump in accordance with the ejection flow amount of each recording head 10.

That is, when the ejection flow amount is small and the recording head 10 does not need so much assistance, the assistive flow amount is reduced. By contrast, when the ejection flow amount is large and the recording head 10 needs much assistance, the assistive flow amount is increased. Thus, the ink supply system 200 automatically controls the assistive flow amount.

As described above, according to the present illustrative embodiment, in an apparatus including a plurality of ink supply systems employing a plurality of color inks, the pumps separately provided for the plurality of ink supply systems are collectively driven using one actuator. Such a configuration allows a relatively simple configuration and control of the apparatus, thus allowing cost reduction and downsizing.

Since the viscosity of liquid varies with the temperature of the liquid, it may be preferable that for the flow assistance of liquid to the recording head 10, for example, the driving of the pump 78 is controlled by feeding back the ambient temperature of the inkjet recording apparatus 100, which is determined with, e.g., a temperature sensor 27 mounted on the carriage 4 as illustrated in FIG. 2, the internal temperature of the inkjet recording apparatus 100, the temperature of ink, and/or predicted values of the foregoing temperatures. Such a configuration allows proper response to temperature change, further enhancing the convenience for users.

Further, a pressure sensor may be provided in the ink supply channels to detect a change in pressure when ink is ejected at a predetermined flow amount from the recording head 10. Thus, since the viscosity of ink, which directly affects pressure loss, is detected, control parameters of the pump 78 are adjusted in accordance with the detected viscosity, thus allowing using inks of different viscosities.

The inkjet recording apparatus 100 may be configured so that a user can input such control parameters of the pump 78 while checking the ejection state of ink. Such a configuration allows obviating the above-described sensor for detecting the viscosity of liquid, thus allowing a further simple configuration of the inkjet recording apparatus 100.

As described above, the pressure regulation valve is provided in a supply channel that supplies liquid from the liquid tank (the ink cartridge 76) to the liquid ejection head (recording head), another channel is provided to connect the pressure regulation valve to the liquid tank through a route differing from the route of the supply channel, and the liquid feed unit is provided in the latter channel. The pressure regulation valve changes the resistance of the internal channel in response to the flow amount of liquid that flows into the liquid ejection head. At least when liquid is ejected from the liquid ejection head, liquid is fed to the liquid ejection head using the liquid feed unit in a state in which the liquid ejection head is connected to the liquid tank. As a result, an appropriate assistance pressure, while automatically controlled, is applied to the liquid ejection head in response to the ejection amount of the liquid ejection head. Such a configuration can prevent refill shortage involving an increased length of the liquid supply tube, an increased ejection flow amount of liquid, a high viscosity of liquid, or the like.

In such a case, the pressure regulation valve has the first regulating portion at the liquid ejection side and the second regulating portion at the liquid tank side, and the channel from the liquid feed unit is connected to a portion between the first regulating portion and the second regulating portion. The regulating amount of the second regulating portion is configured to vary depending on the flow amount of liquid that flows into the liquid ejection head. Such a simple configuration utilizing the regulation of the flow amount of the channel allows applying a proper level of assistance pressure to the liquid ejection head while automatically adjusting the pressure in response to the ejection amount of the liquid ejection head.

Further, the pressure regulation valve has a movable member that moves in the ejection amount of the liquid ejection head. The regulation amount of the second regulating portion at the liquid tank side varies with moving of the movable member. Such a simple configuration utilizing the moving of the movable member caused by the flow of liquid allows applying a proper level of assistance pressure to the liquid ejection head while automatically adjusting the pressure in response to the ejection amount of the liquid ejection head.

The movable member is an axial member with a plurality of steps of different diameters in the liquid flow direction and is movably housed in a free state within the channel formation member that forms the internal channel of the pressure regulation valve. Such a configuration facilitates formation of components with high precision, thus allowing producing the pressure regulation valve with high precision.

Next, a second illustrative embodiment of the present disclosure is described with reference to FIGS. 12 to 15.

Figure 12:
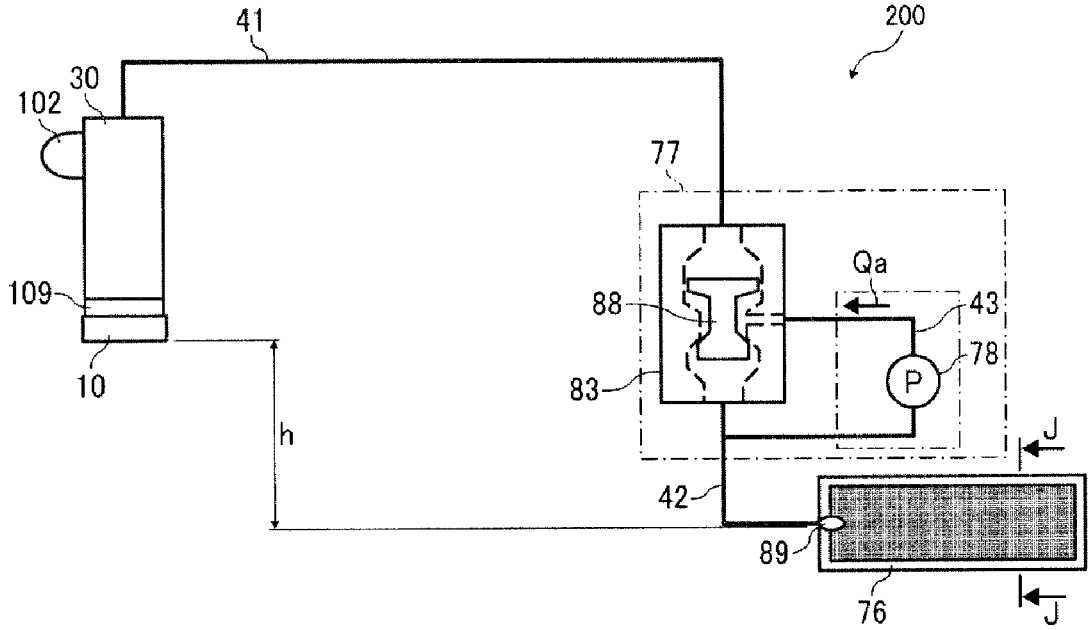
FIG. 12 is a schematic view illustrating an ink supply system according to a second illustrative embodiment.
Figure 13A:
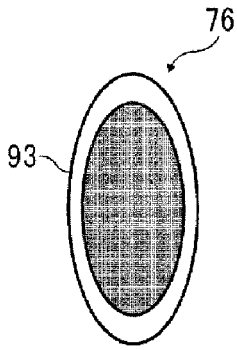
FIGS. 13A and 13B are cross-sectional views illustrating an ink cartridge cut along a line J-J in FIG. 12.
Figure 13B:
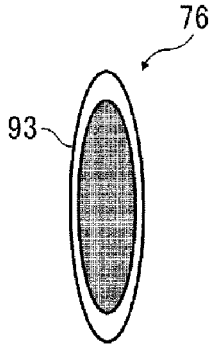
Figure 14A:
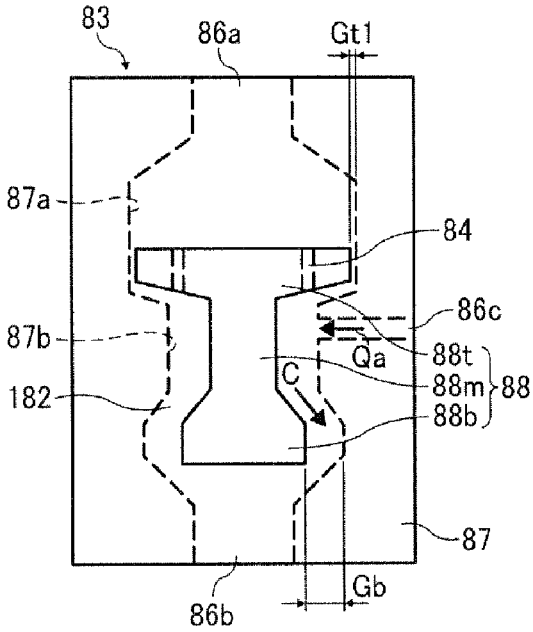
FIGS. 14A and 14B are schematic views illustrating a channel-resistance adjustment unit of the ink supply system illustrated in FIG. 12.
Figure 14B:
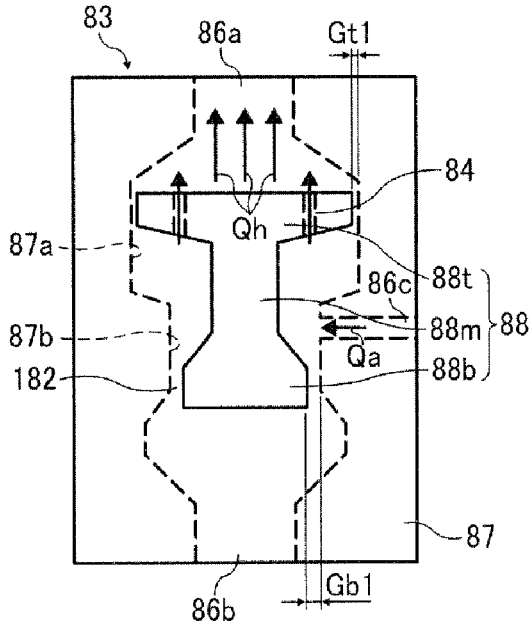
Figure 15:
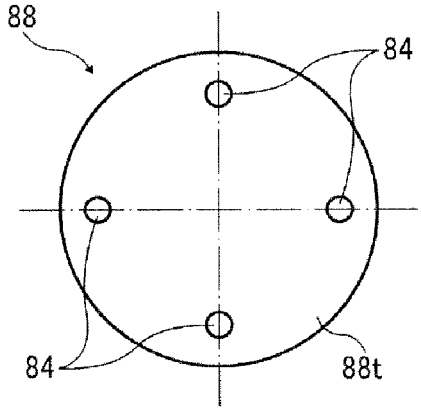
FIG. 15 is a plan view illustrating a valve member of the channel-resistance adjustment unit illustrated in FIGS. 14A and 14B.

FIG. 12 is a schematic view illustrating an ink supply system 200 according to the second illustrative embodiment. FIGS. 13A and 13B are cross-sectional views illustrating an ink cartridge 76 cut along a line J-J in FIG. 12. FIGS. 14A and 14B are schematic views illustrating a channel-resistance adjustment unit 83 of the ink supply system 200. FIG. 15 is a plan view illustrating a valve member 88 of the channel-resistance adjustment unit 83.

In the present illustrative embodiment, a pump 78 and the channel-resistance adjustment unit 83 are integrally provided in a cartridge holder 77. Such a configuration allows downsizing and reducing the number of sealing members or other members involving connections between components.

In the ink cartridge 76, ink is contained within a pack 93 formed of a flexible member that is deformable with ink consumption, e.g., from a state illustrated in FIG. 13A to a state illustrated in FIG. 13B. The ink cartridge 76 is located lower than a nozzle face of a recording head 10.

With such a configuration, the ink supply system 200 is configured as a sealed system, thus stably maintaining the quality of ink. Further, in this configuration, the difference in elevation between the recording head 10 and the ink cartridge 76 stably maintains the recording head 10 at a negative pressure.

In the channel-resistance adjustment unit 83, as illustrated in FIG. 14, the diameter of the top portion 88*t* of the valve member 88 is larger than the diameter of the top portion 88*t* according to the first illustrative embodiment, and the gap Gt1 between the top portion 88*t* and the inner wall surface of the channel portion 87*a* of the pipe member 87 is narrower than the gap Gt of the first illustrative embodiment illustrated in FIGS. 10A and 10B.

Further, as illustrated in FIG. 15, the top portion 88*t* of the valve member 88 is provided with through holes 84 formed along the flow direction of ink. The through holes 84 serve as a first regulating portion and a communication path connecting a first channel member 41 and a third channel member 43.

In the ink supply system 200, by the flow of ink caused by the ink ejection of the recording head 10, the valve member 88 is moved to change the fluid resistance between the bottom portion 88*b* of the valve member 88 and the pipe member 87. The force of moving the valve member 88 is created at the regulating portion of the top portion 88*t* of the valve member 88. In the present illustrative embodiment, the first regulation portion is formed of the through holes 84 at the top portion 88*t* of the valve member 88, thus allowing precise processing and stable regulating performance.

In FIG. 15, the through holes 84 are evenly distributed at four positions around the central axis of the valve member 88. Alternatively, the thorough holes of a smaller size may be used with a reduced number of the through holes, or the thorough holes of a larger size may be used with an increased number of the through holes. However, in order to move the valve member 88 straight using the flow caused by ink ejection from the recording head 10, it may be preferable that the through holes 84 are evenly distributed with respect to a circumferential direction of the top portion 88*t* of the valve member 88.

Figure 16:
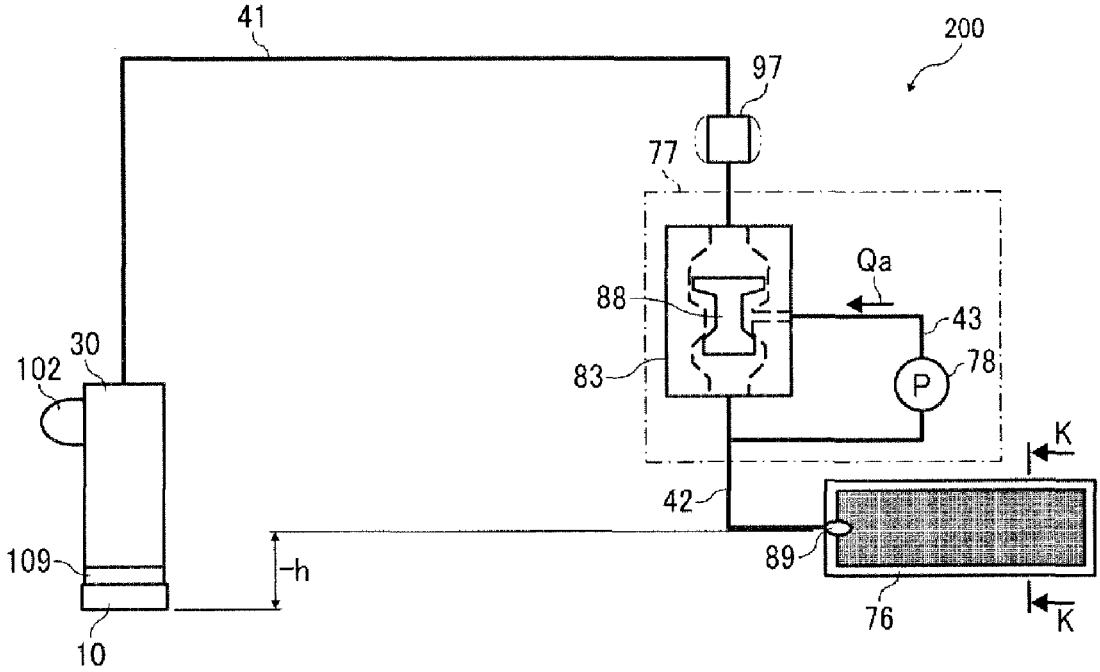
FIG. 16 is a schematic view illustrating an ink supply system according to a third illustrative embodiment.
Figure 17A:
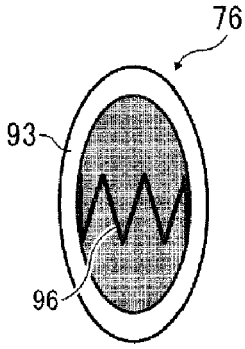
FIGS. 17A and 17B are cross-sectional views illustrating an ink cartridge cut along a line K-K in FIG. 16.
Figure 17B:
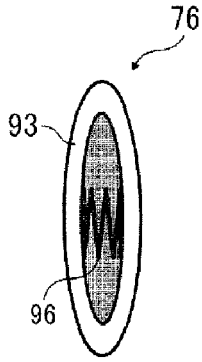
Figure 18A:
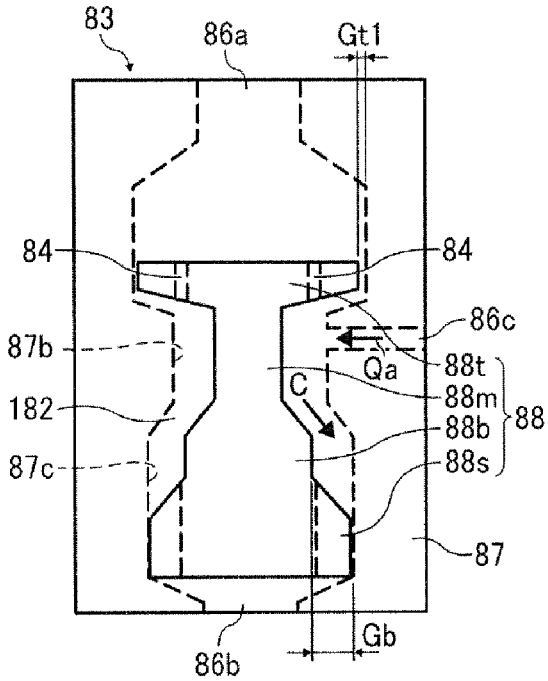
FIGS. 18A and 18B are schematic views illustrating a channel-resistance adjustment unit of the ink supply system illustrated in FIG. 16.
Figure 18B:
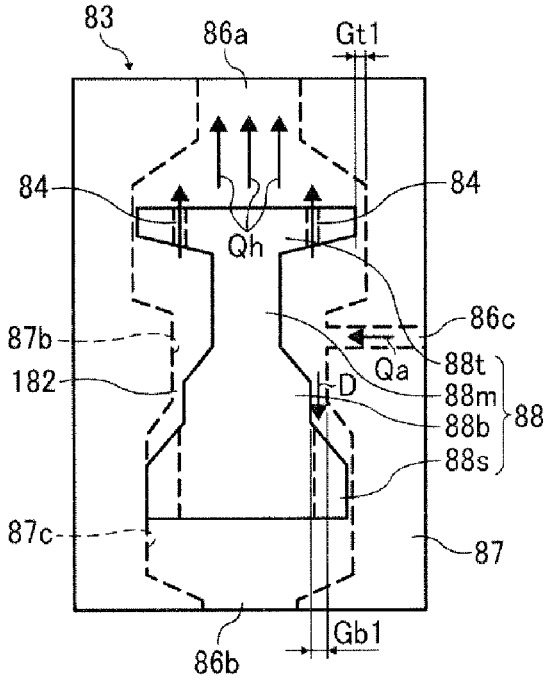
Figure 19:
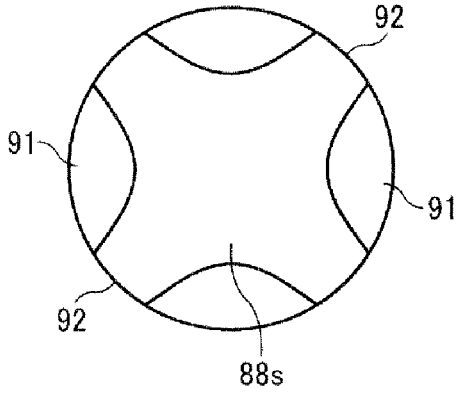
FIG. 19 is a bottom view illustrating an example of a valve member of the channel-resistance adjustment unit illustrated in FIGS. 18A and 18B.
Figure 20:
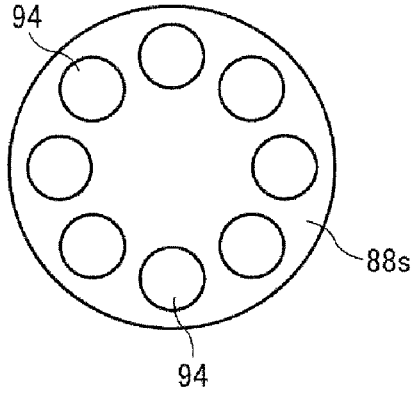
FIG. 20 is a bottom view illustrating another example of the valve member of the channel-resistance adjustment unit illustrated in FIGS. 18A and 18B.

Next, a third illustrative embodiment of the present disclosure is described with reference to FIGS. 16 to 20. FIG. 16 is a schematic view illustrating a configuration of an ink supply system 200 according to the third illustrative embodiment. FIGS. 17A and 17B are cross-sectional views illustrating an ink cartridge 76 cut along a line K-K in FIG. 16. FIGS. 18A and 18B are schematic views illustrating a channel-resistance adjustment unit 83 of the ink supply system 200. FIG. 19 is a bottom view illustrating an example of a valve member 88 of the channel-resistance adjustment unit 83. FIG. 20 is a bottom view illustrating another example of the valve member 88 of the channel-resistance adjustment unit 83.

In the ink cartridge 76, ink is contained within a pack member 93 formed of a flexible member that is deformable with ink consumption, e.g., from a state illustrated in FIG. 17A to a state illustrated in FIG. 17B. In the pack member 93 is provided a compression spring 96.

Such a configuration allows the ink cartridge 76 of itself to generate a negative pressure, thus allowing the ink cartridge 76 to be disposed at a position higher (by an elevation difference of "–h") than the nozzle surface of the recording head 10, e.g., as illustrated in FIG. 16.

As illustrated in FIG. 18, in the channel-resistance adjustment unit 83, the thorough holes 84 serving as the first regulating portion of a relatively small diameter are formed at the top portion 88*t* of the valve member 88, and the valve member 88 is drawn by ink flow Qh to move in a pipe member 87.

As illustrated in FIGS. 18A, 18B, and 19, a slide portion 88*s* that slides along an inner wall surface 87*c* of the pipe member 87 is provided at the bottom portion 88*b* of the valve member 88. At a periphery of the slide portion 88*s* are formed grooves 91 through which ink flows.

As the ink channel in the slide portion 88*s* of the valve member 88, through holes 94 illustrated in FIG. 19 may be formed instead of the grooves 91 to enable ink to flow in and out. However, in the configuration illustrated in FIG. 19, forming the grooves 91 at the periphery of the slide portion 88*s* results in a reduced area in which slide surfaces 92 contact the inner wall surface 87*c*. Accordingly, such a configuration reduces the sliding resistance between the pipe member 87 and the valve member 88, thus allowing smoother movement of the valve member 88.

Further, in the present illustrative embodiment, a buffer unit 97 is provide between the liquid supply tube 41 and the pump 78. The buffer unit 97 may be formed with a container having at least one wall surface of a flexible material, e.g., film or rubber, and/or a certain thickness of a gas layer. The buffer unit 97 suppresses unnecessary pressure pulsation caused by the pump 78 and absorbs transient pressure fluctuation at the start and stop of the pump 78, thus stabilizing the pressure of the recording head 10.

Figure 21:
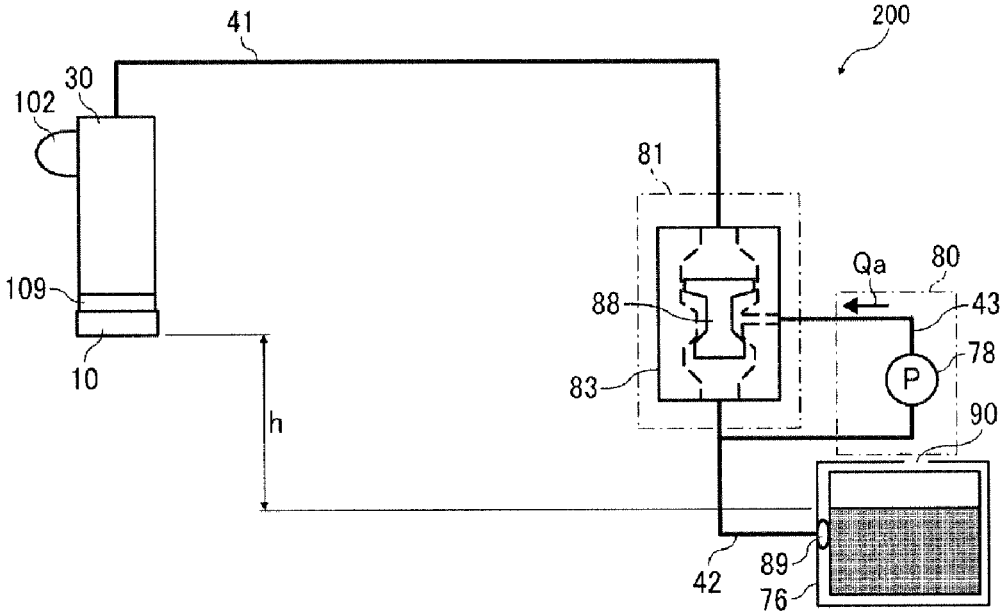
FIG. 21 is a schematic view illustrating a configuration of an ink supply system according to a fourth illustrative embodiment.
Figure 22A:
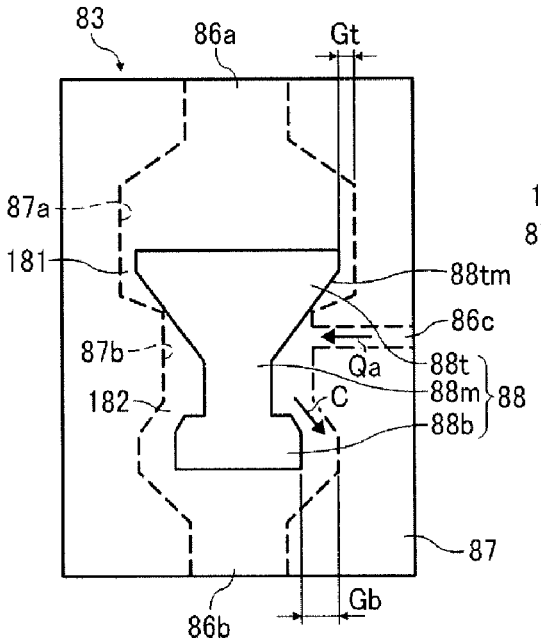
FIGS. 22A and 22B are schematic views illustrating a channel-resistance adjustment unit of the ink supply system illustrated in FIG. 21.
Figure 22B:
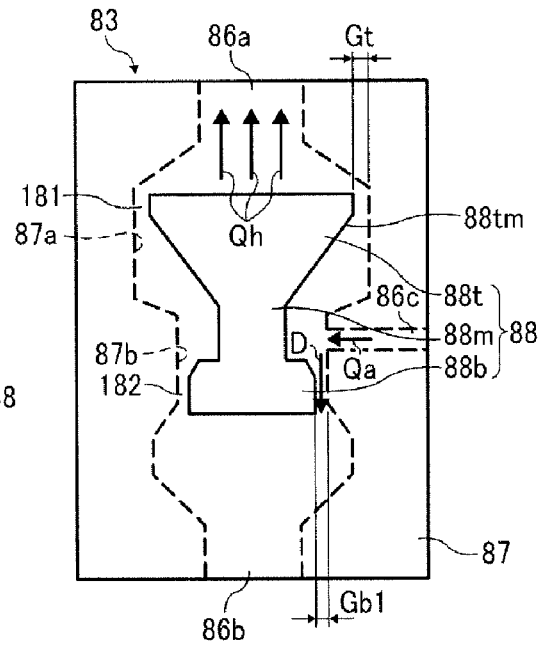

Next, a fourth illustrative embodiment of the present disclosure is described with reference to FIGS. 21, 22A, and 22B. FIG. 21 is a schematic view illustrating a configuration of an ink supply system 200 according to the fourth illustrative embodiment. FIGS. 22A and 22B are schematic views illustrating a channel-resistance adjustment unit 83 of the ink supply system 200.

In the fourth illustrative embodiment, instead of the channel-resistance adjustment unit 83 illustrated in FIGS. 10A and 10B, the channel-resistance adjustment unit 83 illustrated in FIGS. 22A and 22B is used in the ink supply system 200 according to the first illustrative embodiment. In the channel-resistance adjustment unit 83 illustrated in FIGS. 22A and 22B, a slanted surface (taper surface) 88*tm* is formed at a connecting portion between a top portion 88*t* of a valve member 88 and a middle portion 88*m* so as to be inclined with respect to an inflow direction of ink from a port 86*c* (side hole) of the third channel member 43.

As described above, in the ink supply system 200 according to the present illustrative embodiment, as illustrated in FIG. 22B, a gap Gt between the pipe member 87 and the top portion 88*t* of the valve member 88 is set narrow. As a result, by the ink flow caused by ink ejection from the recording head 10, which is indicated by arrows Qh, the valve member 88 is attracted to move toward a port 86*a*. When the bottom portion 88*b* of the valve member 88 is moved to a small-diameter portion (channel portion 87*b*) of the pipe member 87, a gap Gb between the pipe member 87 and the bottom portion 88*b* of the valve member 88 is narrowed into a gap Gb1 illustrated in FIG. 22B. The ink fed from the third channel member 43 with the pump 78, which is indicated by an arrow "Qa", flows into the gap Gb1 (indicated by an arrow "D"), thus creating pressure. Such pressure reduces the pressure loss arising when ink flows into the recording head 10, thus allowing supplying a large amount of ink.

As described above, such pressure increasing effect is determined depending on the shape of the gap Gb1 of the second regulating portion 182 of the channel-resistance adjustment unit 83 and the flow amount of liquid passing through the second regulating portion 182. In such a case, it is conceivable that the flow amount of liquid flowing in the direction indicated by the arrow D in FIG. 22B might be increased to obtain the pressure increasing effect. However, increasing the flow amount of liquid passing through the gap Gb1 (the second regulating portion 182) results in an increased resistance against the liquid flow of the gap Gb1, thus creating a force of pushing the valve member 88 downward. When the valve member 88 is pushed down, the length of the gap Gb1 is shortened. As a result, the increase in the flow amount may not cause pressure increase, thus resulting in saturation of assistive pressure.

Hence, in the present illustrative embodiment, the taper surface 88*tm* is formed at the valve member 88 of the channel-resistance adjustment unit 83 so as to face the port 86*c* forming the third channel member 43. As a result, when the valve member 88 moves down, the liquid flowing from the port 86*c* gives a resistance against the valve member 88, thus generating a force to move the valve member 88 up. In such a case, as the inflow amount Qa of liquid from the third channel member 43 is increased, the resistance against the valve member 88 is also increased. Accordingly, the valve member 88 is moved down to prevent reduction of assistive pressure, thus allowing a relatively large level of refill assistance.

As described above, in the present illustrative embodiment, the pressure regulating valve is provided at a supply channel that supplies liquid from the liquid tank to the liquid ejection head. Another channel is provided to connect the pressure regulating valve to the liquid tank through a route differing from the route of the supply channel, and the liquid feed unit is provided in the latter channel. The pressure regulating valve changes the resistance of the internal channel depending on the flow amount of liquid that flows into the liquid ejection head. At least when liquid is ejected from the liquid ejection head, liquid is fed to the liquid ejection head using the liquid feed unit in a state in which the liquid ejection head is connected to the liquid tank. As a result, a proper assistance pressure, while automatically controlled, is applied to the liquid ejection head in response to the ejection amount of the liquid ejection head. Such a configuration can prevent refill shortage involving an increased length of the liquid supply tube, an increased ejection flow amount of liquid, a high viscosity of liquid, or the like in a simple manner. Further, in the pressure regulating valve, the movable member has a slanted surface and is pushed by the liquid flow to the pressure regulating valve created by the liquid feed unit. Such a configuration prevents unnecessary moving of the movable member caused by an increased liquid feed amount of the liquid feed unit, thus effectively reducing the pressure loss. Accordingly, the liquid ejection head is maintained in a proper range of negative pressures using a simple configuration and control, and high-viscosity liquid can be ejected at a high speed while preventing ejection failure.

Figure 23:
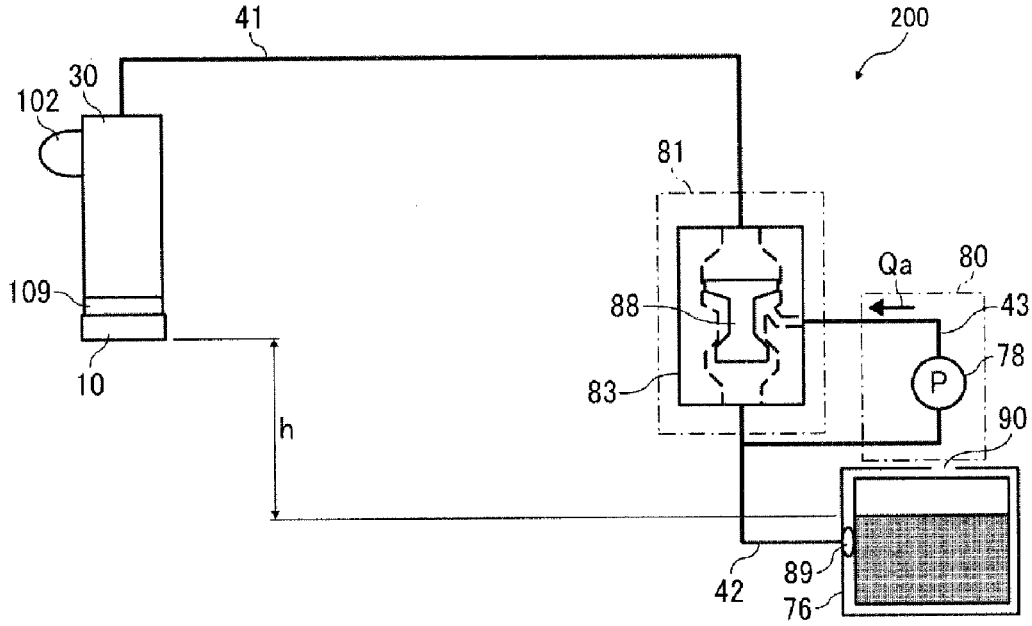
FIG. 23 is a schematic view illustrating an ink supply system according to a fifth illustrative embodiment.
Figure 24A:
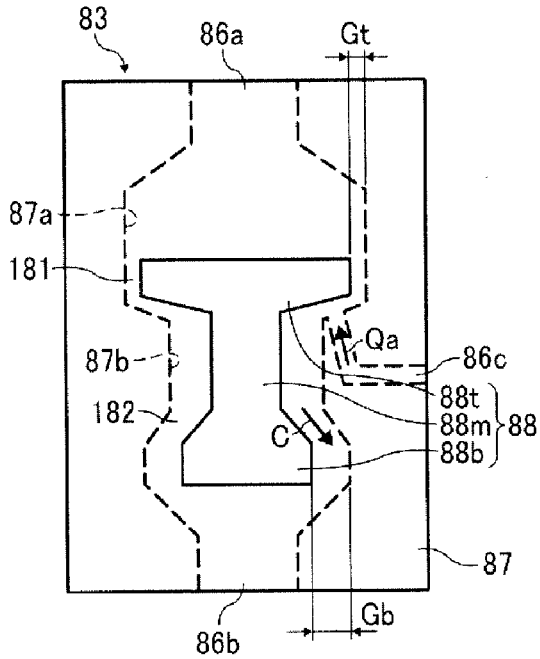
FIGS. 24A and 24B are schematic views illustrating a channel-resistance adjustment unit of the ink supply system illustrated in FIG. 23.
Figure 24B:
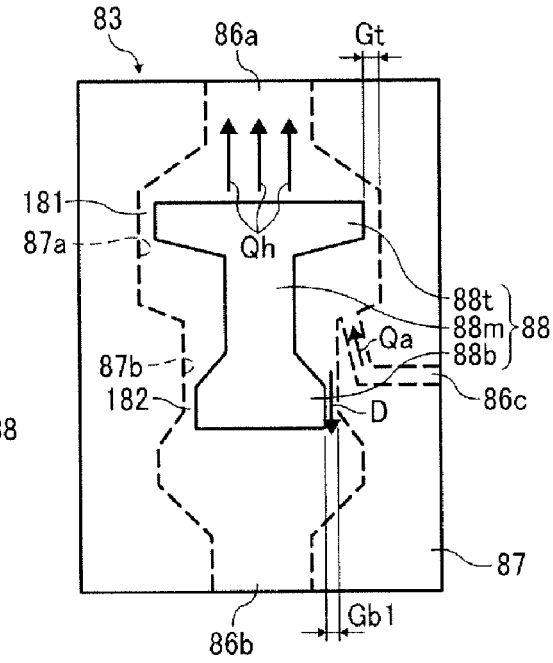

Next, a fifth illustrative embodiment of the present disclosure is described with reference to FIGS. 23, 24A, and 24B. FIG. 23 is a schematic view illustrating a configuration of an ink supply system 200 according to the fifth illustrative embodiment. FIGS. 24A and 24B are schematic views illustrating a channel-resistance adjustment unit 83 of the ink supply system 200.

In the fifth illustrative embodiment, instead of the channel-resistance adjustment unit 83 illustrated in FIGS. 10A and 10B, the channel-resistance adjustment unit 83 illustrated in FIGS. 24A and 24B is used in the ink supply system 200 according to the first illustrative embodiment. In the channel-resistance adjustment unit 83 illustrated in FIGS. 24A and 24B, an opening of a port 86*c* connected to a third channel member 43 is formed facing a lower surface of a top portion 88*t* of a valve member 88.

In such a configuration, as illustrated in FIG. 24B, liquid is fed from a port 86*c* using a pump 78 toward a lower surface of a top portion 88*t* of the valve member 88 to push up the valve member 88. As a result, the downward moving of the valve member 88 is suppressed, thus preventing reduction of assistance effectiveness.

As described above, in the present illustrative embodiment, the pressure regulating valve is provided at a supply channel that supplies liquid from the liquid tank to the liquid ejection head. Another channel is provided to connect the pressure regulating valve to the liquid tank through a route differing from the route of the supply channel, and the liquid feed unit is provided in the latter channel. The pressure regulating valve changes the resistance of the internal channel depending on the flow amount of liquid that flows into the liquid ejection head. At least when liquid is ejected from the liquid ejection head, liquid is fed to the liquid ejection head using the liquid feed unit in a state in which the liquid ejection head is connected to the liquid tank. As a result, while automatically controlled, a proper assistance pressure is applied to the liquid ejection head in response to the ejection amount of the liquid ejection head. Such a configuration can prevent refill shortage involving an increased length of the liquid supply tube, an increased ejection flow amount of liquid, a high viscosity of liquid, or the like in a simple manner. Further, the movable member is pushed by a liquid flow formed in the same direction as the liquid flow in the pressure regulating valve caused by liquid ejection from the liquid ejection head. Such a configuration prevents unnecessary moving of the movable member caused by an increased liquid feed amount of the liquid feed unit, thus effectively reducing the pressure loss.

Figure 25A:
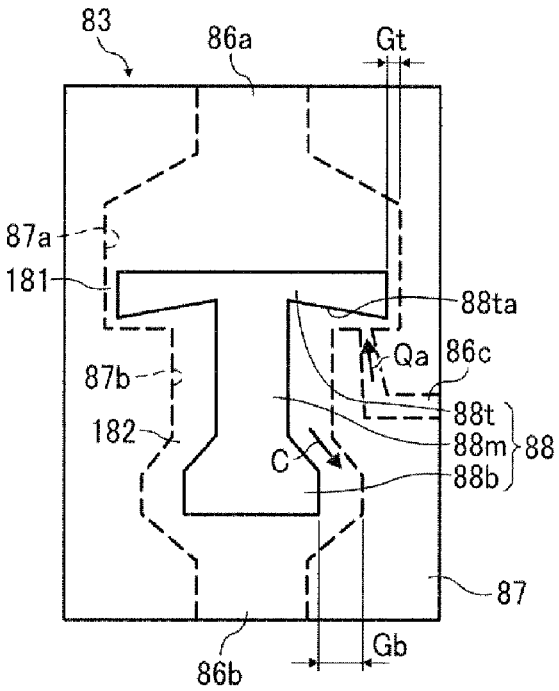
FIGS. 25A and 25B are schematic views illustrating a channel-resistance adjustment unit of an ink supply system according to a sixth illustrative embodiment.
Figure 25B:
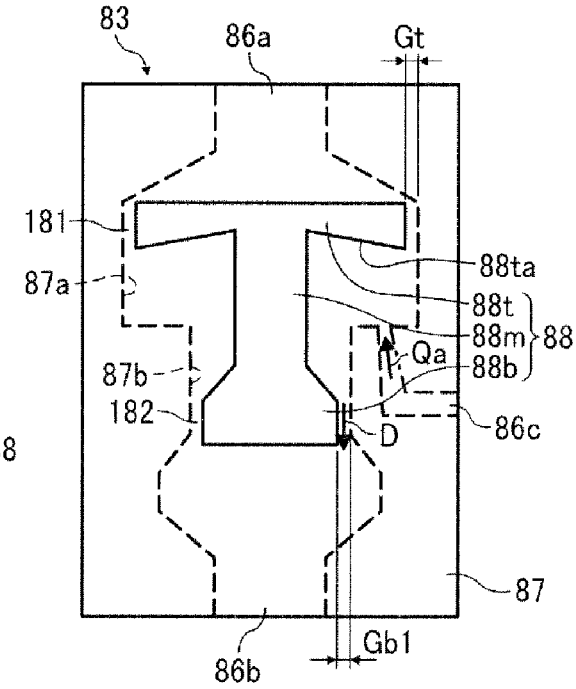

Next, a sixth illustrative embodiment of the present disclosure is described with reference to FIGS. 25A and 25B. FIGS. 25A and 25B are schematic views illustrating a channel-resistance adjustment unit 83 of an ink supply system 200 according to the sixth illustrative embodiment.

A valve member 88 of the channel-resistance adjustment unit 83 has a top portion 88. A back surface of the top portion 88 facing a port 86*c* is formed to be gradually thinner toward the center portion of the back surface. In other words, by forming an inclined surface 88*ta* inclined in a liquid flow direction toward the center portion, a space into which liquid flows from the port 86*c* is formed in a mountain shape. In such a configuration, when liquid flows from the port 86*c* toward the back surface of the top portion 88*t* of the valve member 88, the liquid concentrates around the central portion of the valve member 88, allowing effective application of an upward-moving force to the valve member 88.

The port 86*c* is tapered toward the exit (outlet) thereof. Such a configuration allows increasing the flow speed of liquid outflowing from the port 86*c* and the resistance against the valve member 88, thus enhancing the assistance efficiency.

Figure 26A:
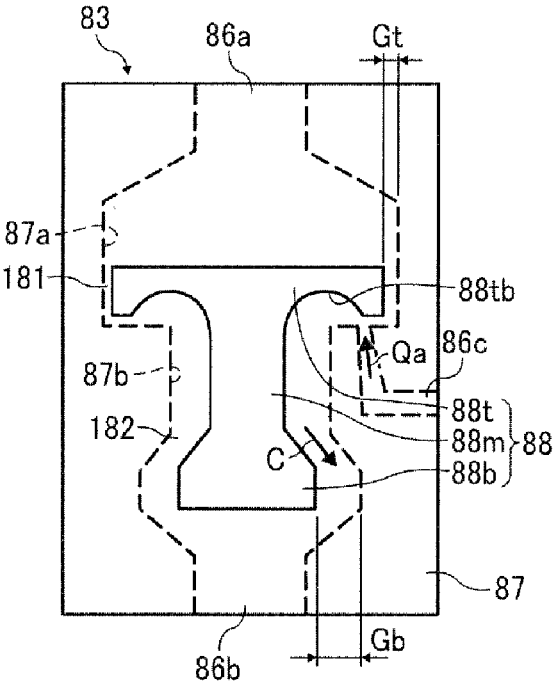
FIGS. 26A and 26B are schematic views illustrating a channel-resistance adjustment unit of an ink supply system according to a seventh illustrative embodiment.
Figure 26B:
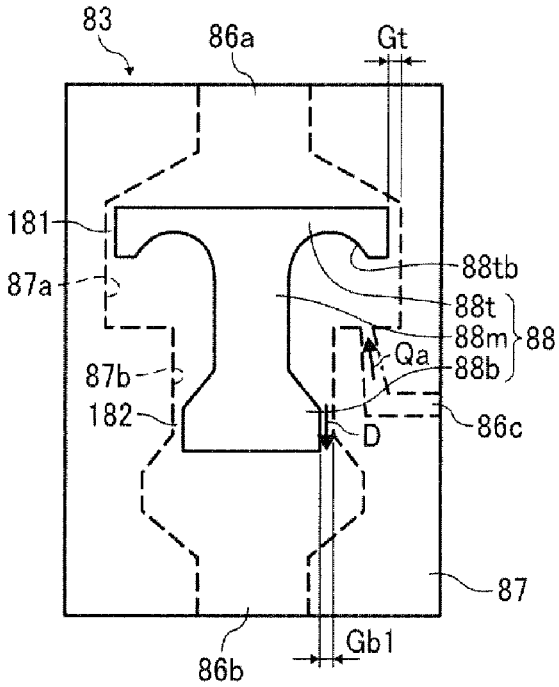

Next, a seventh illustrative embodiment of the present disclosure is described with reference to FIGS. 26A and 26B. FIGS. 26A and 26B are schematic views illustrating a channel-resistance adjustment unit 83 of an ink supply system 200 according to the seventh illustrative embodiment.

A valve member 88 of the channel-resistance adjustment unit 83 has a recessed portion 88*tb* at a back surface side of a top portion 88*t* that faces a port 86*c*, and the recessed portion 88*tb* has a curved face dented in the direction in which liquid flows. In such a configuration, when liquid flows from the port 86*c* toward the back surface of the top portion 88*t* of the valve member 88, the liquid concentrates around the central portion of the valve member 88, thus allowing effective application of an upward-moving force to the valve member 88. Further, the liquid flow is smoothly turned around without reducing the flow speed and sent into a gap Gb1 (of a second regulating portion 182), thus creating assistance pressure. Thus, such a configuration allows creating a good assistance pressure at a relatively low flow amount of liquid.

Figure 27:
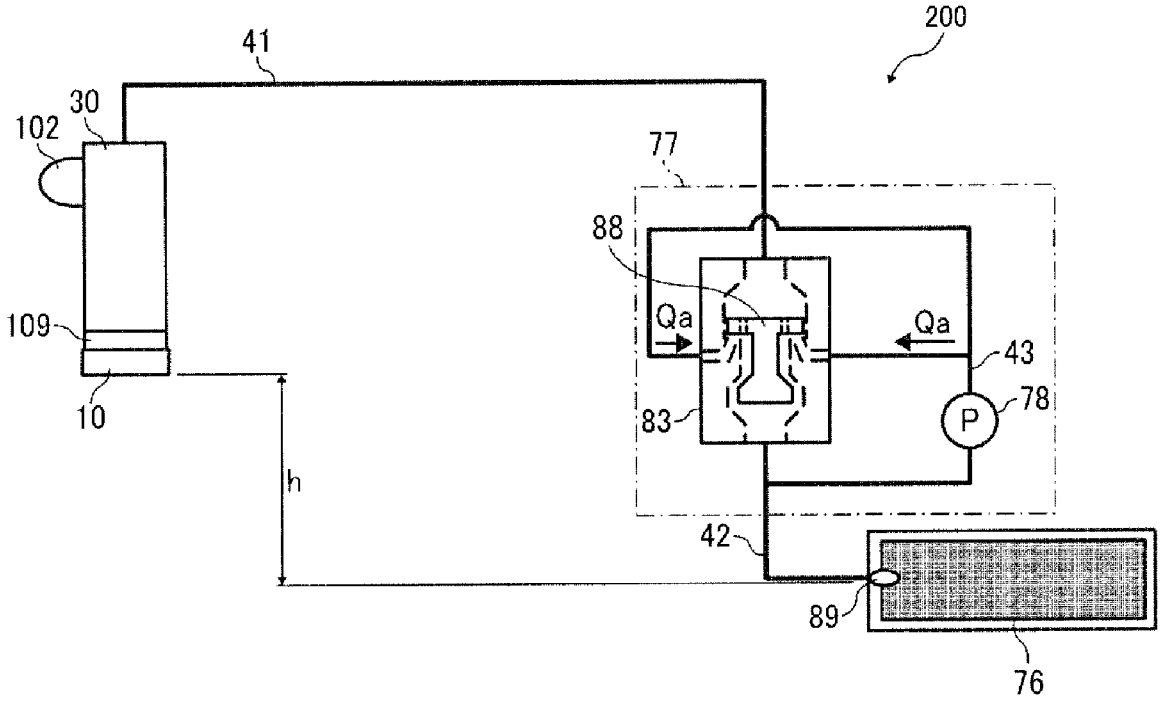
FIG. 27 is a schematic view illustrating an ink supply system according to an eighth illustrative embodiment.
Figure 28A:
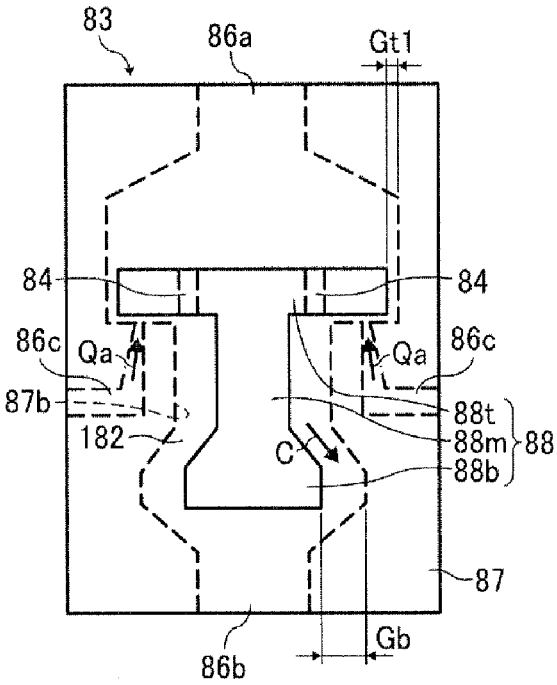
FIGS. 28A and 28B are schematic views illustrating a channel-resistance adjustment unit of the ink supply system illustrated in FIG. 27.
Figure 28B:
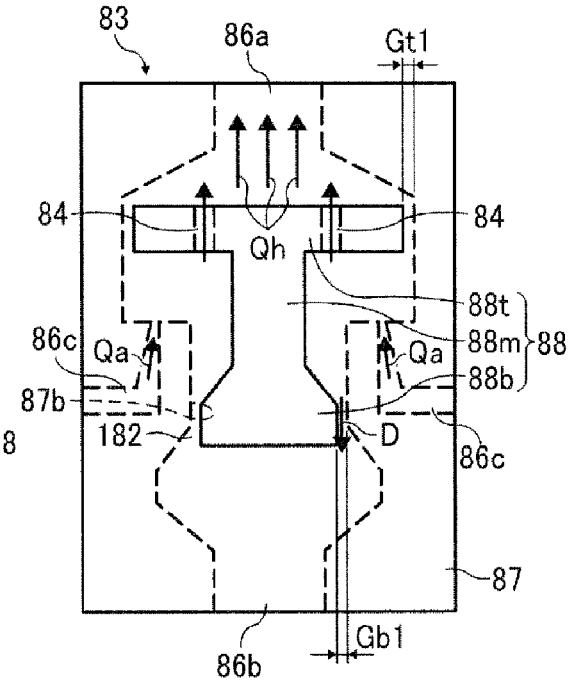
Figure 29:
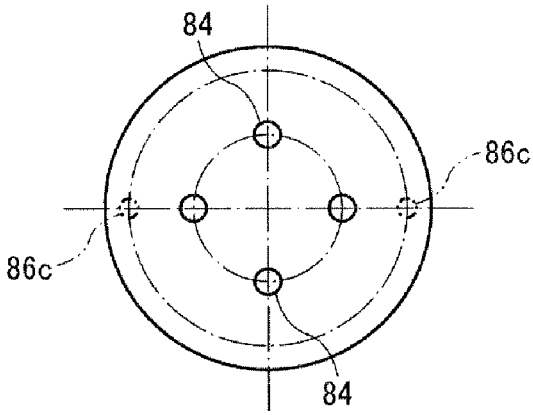
FIG. 29 is a plan view illustrating a valve member of the channel-resistance adjustment unit illustrated in FIGS. 28A and 28B.

Next, an eighth illustrative embodiment is illustrated with reference to FIGS. 27 to 29. FIG. 27 is a schematic view illustrating a configuration of an ink supply system 200 according to the eighth illustrative embodiment. FIGS. 28A and 28B are schematic views illustrating a channel-resistance adjustment unit 83 of the ink supply system 200. FIG. 29 is a plan view illustrating a valve member 88 of the channel-resistance adjustment unit 83.

In this illustrative embodiment, the sealed ink cartridge 76 described in the second illustrative embodiment (see FIGS. 12, 13A, and 13B) is used in the fifth illustrative embodiment.

In the channel-resistance adjustment unit 83 according to the fifth illustrative embodiment, as with the second illustrative embodiment, as illustrated in FIGS. 28A and 28B, the diameter of a top portion 88*t* of the valve member 88 is greater than that of the fifth illustrative embodiment and the gap Gt1 between the top portion 88*t* and an inner wall surface of a channel portion 87*a* of a pipe member 87 is set narrower than the gap Gt of the fifth illustrative embodiment. Further, the top portion 88*t* of the valve member 88 has through holes 84 serving as the first regulating portion that are formed along the ink flow direction.

The pipe member 87 of the channel-resistance adjustment unit 83 has a plurality of ports 86*c* (two ports in FIG. 29) connected to a third channel member 43. As illustrated in FIG. 29, the ports 86*c* are disposed opposite in the radial direction of the valve member 88. The port 86*c* are evenly distributed at positions not facing the through holes 84 of the valve member 88 so that a drag force acts on the valve member 88 in a balanced manner.

Such a configuration can provide the same effects as those described in the second and fifth illustrative embodiments.

As described above, in the present illustrative embodiment, the plurality of inlets of liquid (outlets of the third channel member) from the third channel member to the pressure regulating valve is evenly distributed on the positions facing the valve member of the pressure regulating valve. Such a configuration allows stable retention of the valve member, thus achieving stable regulating performance.

Figure 30A:
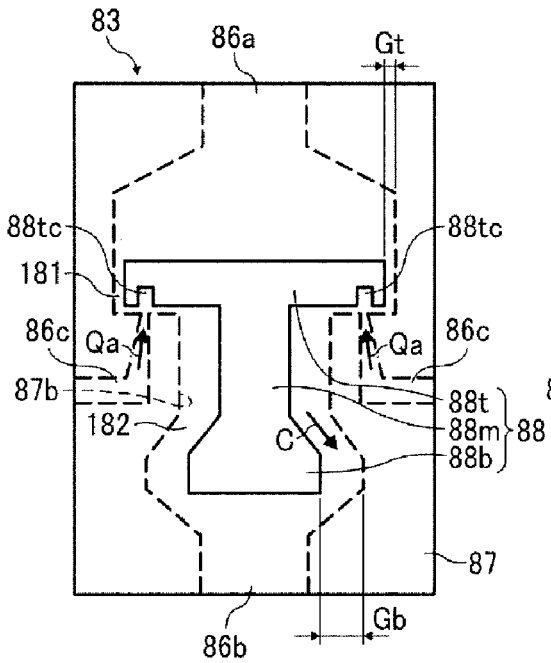
FIGS. 30A and 30B are a channel-resistance adjustment unit according to a ninth illustrative embodiment.
Figure 30B:
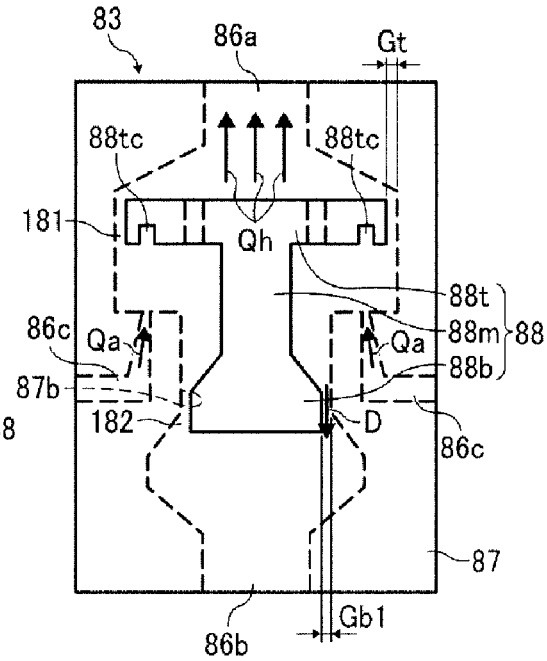

Next, a ninth illustrative embodiment of the present disclosure is described with reference to FIGS. 30A and 30B. FIGS. 30A and 30B are a channel-resistance adjustment unit 83 according to the ninth illustrative embodiment.

The channel-resistance adjustment unit 83 has recessed portions 88*tc* at positions facing liquid outlets of ports 86*c*. Such a configuration reduces a horizontal liquid flow arising after liquid from the ports 86*c* hits against a wall face of a top portion 88*t* of a valve member 88. Thus, the force of the liquid flow is converted to a force of pushing the valve member 88, thus enhancing the efficiency of flow assistance.

As described above, the valve member of the pressure regulating valve has the recess portions at positions facing the inlets of liquid to the pressure regulating valve. With such a configuration, the liquid flow created using the liquid feed unit is effectively used to retain the position of the valve member, thus effectively reducing the pressure loss.

Figure 31:
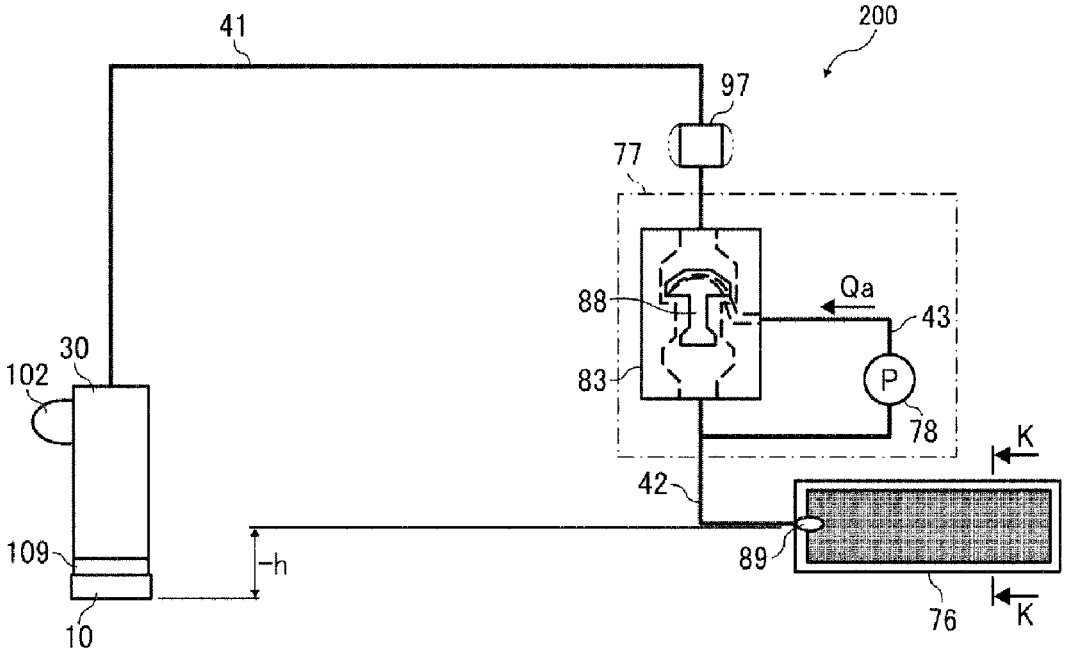
FIG. 31 is a schematic view illustrating an ink supply system according to a tenth illustrative embodiment.

Next, a tenth illustrative embodiment according to the present disclosure is described with reference to FIGS. 31 and 32. FIG. 31 is a schematic view illustrating an ink supply system 200 according to the tenth illustrative embodiment.

Figure 32A:
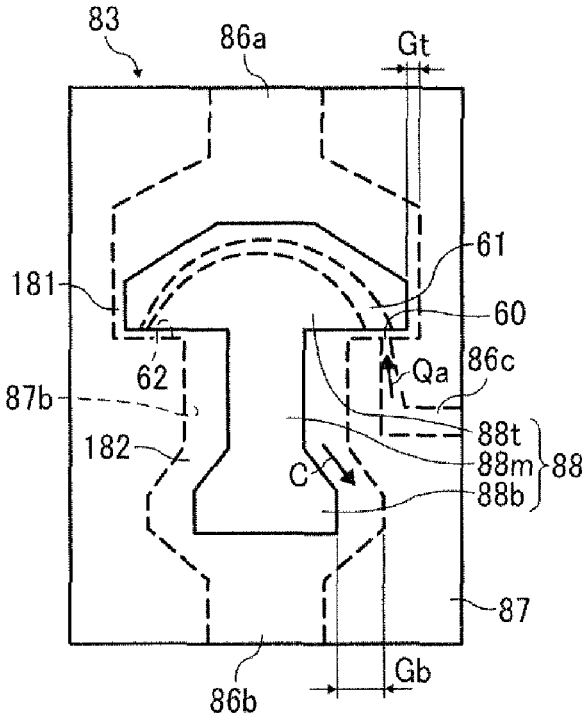
FIGS. 32A and 32B are schematic views illustrating a channel-resistance adjustment unit of the ink supply system illustrated in FIG. 31.
Figure 32B:
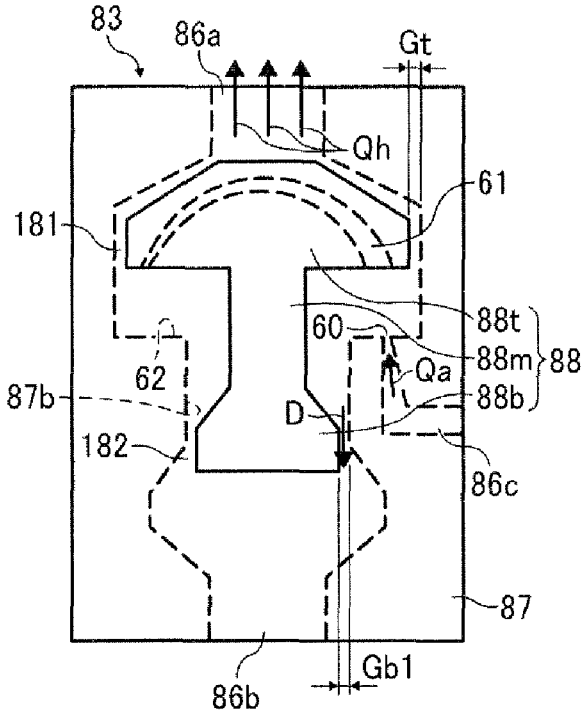

FIGS. 32A and 32B are schematic views illustrating a channel-resistance adjustment unit 83 of the ink supply system 200.

In the tenth illustrative embodiment, the sealed ink cartridge 76 described in the third illustrative embodiment (see FIGS. 16, 17A, and 17B) is used, and a buffer unit 97 is interposed in a first channel member 41.

As illustrated in FIGS. 32A and 32B, the channel-resistance adjustment unit 83 includes a valve member 88 and a port 86*c*. The port 86*c* has an outlet 60 of liquid facing a back surface of a top portion 88*t* of the valve member 88. A through hole 61 serving as a fourth channel member is formed in the top portion 88*t* of the valve member 88 so as to face the outlet 60 of the port 86*c*. As illustrated in FIG. 32B, the through hole 61 changes the flow direction of liquid inflowing from the outlet 60 of the port 86*c* to expel the liquid to a receiving face 62 of a pipe member 87.

As described above, the through hole 61 of the valve member 88 is formed in substantially U-shape to change the liquid flow direction from an upward direction to a downward direction. With such a configuration, the force of pushing the valve member 88 is generated by the reactive force arising when the liquid flow is curved.

The through hole 61 is tapered in the liquid flow direction. In other words, the cross-section area of the through hole 61 gradually decreases in the liquid flow direction. Such a configuration allows increasing the flow speed of liquid expelled from the valve member 88. As a result, the reactive force created by liquid forced against the receiving face 62 acts on the valve member 88, and thus the force of pushing the valve member 88 is generated. Accordingly, such a configuration enhances the efficiency of pressure assistance with the liquid fed from the pump 78.

Next, the initial ink filling operation using the ink supply system 200 according to any of the above-described illustrative embodiments is described with reference to FIG. 33.

Figure 33:
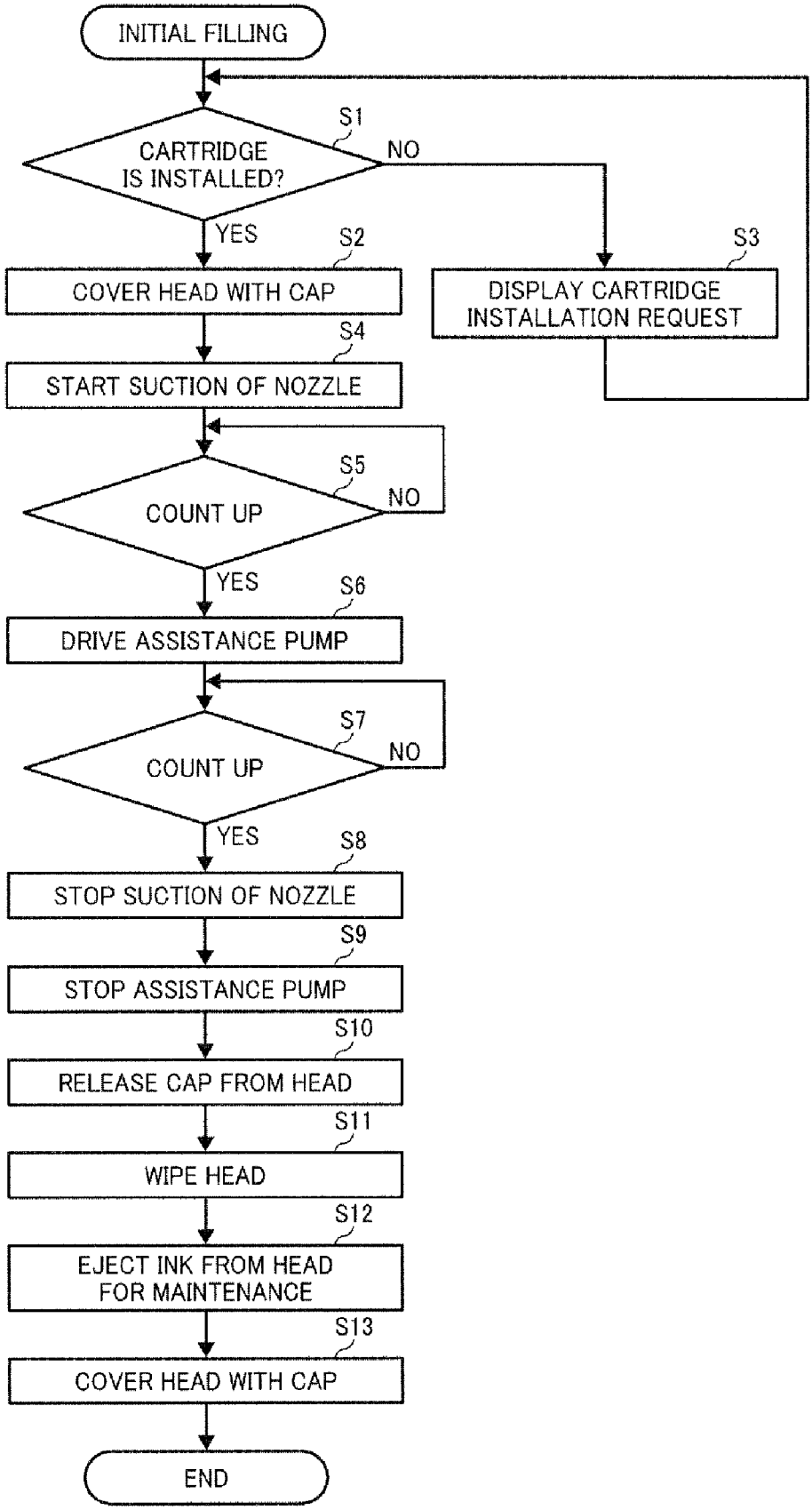
FIG. 33 is a flowchart illustrating an example of initial ink filling operation.

FIG. 33 is a flow chart illustrating a process of the initial ink filling.

When at S1 it is determined that the ink cartridge 76 is installed, at S2 the nozzle face of the recording head 10 is capped with the cap 52 of the maintenance-and-recovery unit 51. With the recording head 10 capped with the cap 52, at S4 the suction pump 53 is driven to suction air in the ink supply channel via the nozzles of the recording head 10 (the start of nozzle suctioning). Thus, ink is fed from the ink cartridge 76 through the second channel member 42 and the pressure regulation unit 81 to the liquid supply tube 41.

When at S5 a predetermined period of time has passed since the start of nozzle suctioning (a timer counts up a predetermined period of time), at S6 the motor 82 is driven to drive the pump (assistance pump) 78. By driving the pump 78, liquid is fed toward the channel-resistance adjustment unit 83 in the direction indicated by the arrow "Qa". Air in the third channel member 43 serving as a bypass connected to the pump 78 is pushed toward the channel-resistance adjustment unit 83 and replaced with ink.

When at S7 a predetermined period of time has passed (the timer counts up a predetermined period of time), both the suction pump 53 and the pump 78 are stopped at S8 and S9. At this time, all of the ink supply channels are filled with ink.

At S10, the capped state of the nozzle face with the cap 52 of the maintenance-and-recovery unit 51 is released. At S11, the nozzle face of the recording head 10 is wiped with a wiper member, not illustrated, of the maintenance-and-recovery unit 51. At S12, the recording head 10 is driven to eject a predetermined number of ink droplets not contributing to image formation, which may be referred to as "preliminary head ejection". Thus, a desired meniscus is formed in each nozzle.

If a recording operation is not subsequently performed, at S13 the nozzle face of the recording head 10 is capped with the cap 52 and the initial ink filling operation is finished.

In the above-described process, the pump (assistance pump) 78 is continuously driven until the nozzle suctioning is stopped. Alternatively, even if the pump 78 is stopped after the above-described ink replacement of the bypass (the third channel member 43) is completed, the initial ink filling can be performed.

In the above-described initial ink filling, the pump 78 is also driven when ink is initially filled into the liquid supply tube 41 and the recording head 10, thus allowing reducing the time required for the initial ink filling.

Figure 34:
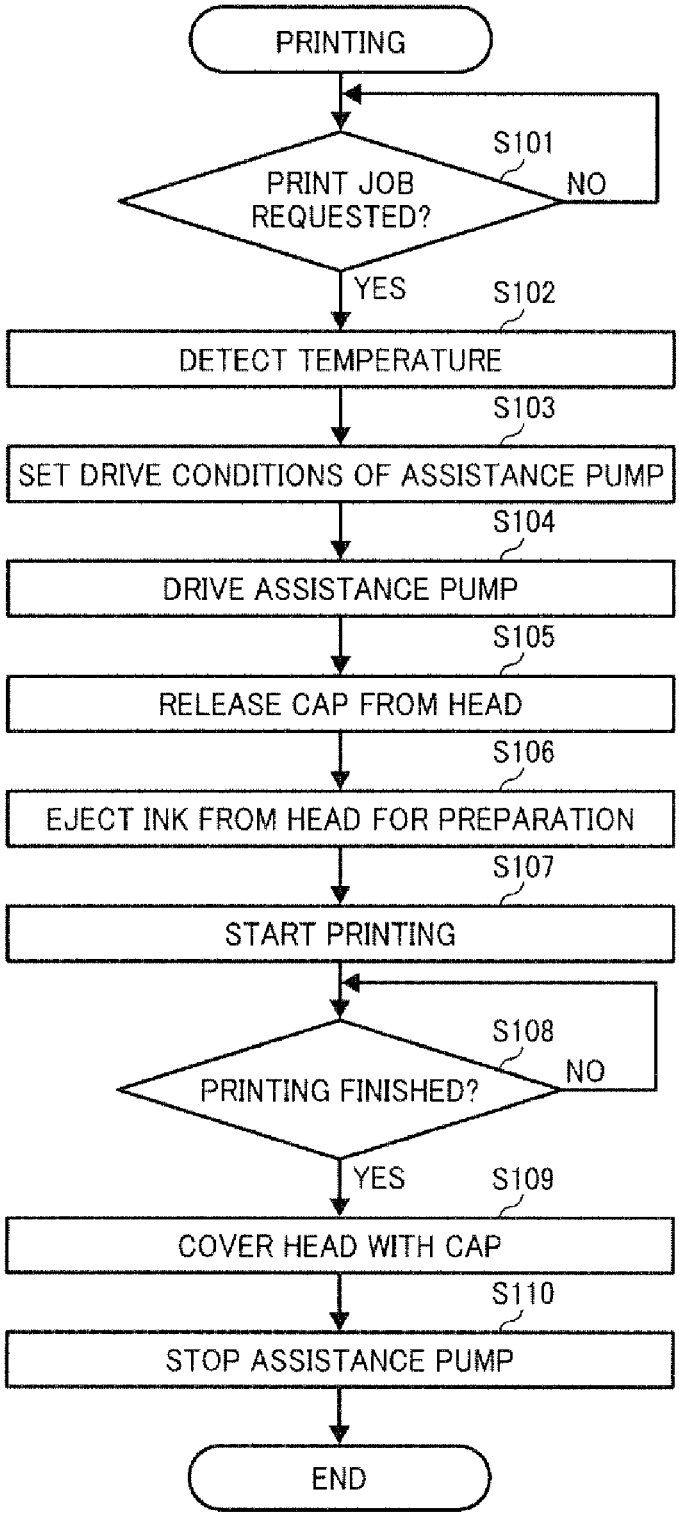
FIG. 34 is a flowchart illustrating an example of printing operation.

Next, printing operation is described with reference to FIG. 34.

If a print job signal is received ("YES" at S101), at S102 the internal temperature (of the inkjet recording apparatus 100) is detected with the temperature sensor 27 to estimate the temperature of ink. As described above, the temperature sensor 27 may be mounted on the carriage 4 in FIG. 2. Alternatively, it is to be noted that the temperature sensor 27 may be disposed at another position such as the ink cartridge 76 or the recording head 10. The temperature sensor 27 may also be disposed in the ink supply channel to directly detect the temperature of ink.

When at 103 the flow amount of ink fed using the pump 78 is determined based on the detected ink temperature, at S104 the pump 78 is started to drive.

At S105, the cap 52 capping the nozzle face of the recording head 10 is separated from the nozzle face (capping release).

At S106, a predetermined number of droplets is ejected for the preliminary head ejection, and at S107 printing is started.

At this time, the pump 78 is being driven. Accordingly, even if a high-viscosity ink is used in a long type of the liquid supply tube 41, the pressure loss involving the ink supply is properly suppressed, thus allowing executing excellent printing while preventing ink supply shortage.

After printing is finished ("YES" at S108), the carriage 4 is stopped at a certain position (home position) of the inkjet recording apparatus 100, at S109 the nozzle face of the recording head 10 is capped and at 5110 the pump is stopped. Alternatively, the pump 78 may be stopped soon after printing is finished.

Further, in the above-described configuration, the liquid feed amount of the pump 78 is controlled based on temperature. However, it is to be noted that, if ink supply and other conditions are satisfied, ink supply may be performed regardless of temperature with a liquid feed amount with which ink can be supplied without ink shortage at an assumed lowest-temperature environment.

The operation and effects of the above-described illustrative embodiments are described using the example in which different color inks are supplied to the plurality of heads. However, it is to be noted that any of the above-described illustrative embodiments is applicable to a configuration in which a single color ink or a plurality of inks prepared with different prescriptions is supplied to a plurality of heads. Alternatively, any of the above-described illustrative embodiments is applicable to an ink supply system that supplies ink to a liquid ejection head having a plurality of nozzle rows to eject different types of liquid. Further, it is to be noted that the above-described image forming apparatus (inkjet recording apparatus) is not limited to an image forming apparatus for ejecting ink in a narrow sense and may be a liquid ejection apparatus (included in the "image forming apparatus" described in this disclosure) that ejects different types of liquid.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

The present patent application claims priority pursuant to 35 U.S.C. §119 from Japanese Patent Application No. 2009-044850, filed on Feb. 26, 2009 in the Japan Patent Office, which is incorporated herein by reference in its entirety.

What is claimed is:

1. An image forming apparatus, comprising:

a recording head having nozzles for ejecting droplets;

a liquid tank that stores liquid to be supplied to the recording head;

a first channel member connected to the recording head;

a second channel member connected to the liquid tank;

a pressure regulation valve including an internal channel that connects the first channel member to the second channel member, a third channel member connecting the pressure regulation valve to one of the second channel member and the liquid tank; and a liquid feed unit disposed on the third channel member to feed the liquid, wherein the pressure regulation valve changes a fluid resistance of the internal channel of the pressure regulation valve in response to a flow amount of the liquid passing through the first channel member and, as liquid droplets are ejected from the nozzles, the liquid feed unit feeds the liquid from the liquid tank to the recording head with the recording head in communication with the liquid tank via the pressure regulation valve.

2. The image forming apparatus according to claim 1, wherein the pressure regulation valve comprises:

a first regulating portion at a position close to the first channel member;

a second regulating portion at a position close to the second channel member;

a connecting portion connected to the third channel member at a position between the first regulating portion and the second regulating portion; and a regulation changer that changes a regulation amount of the second regulating portion in response to the flow amount of liquid passing through the first channel member.

3. The image forming apparatus according to claim 2, wherein the regulation changer is a movable member that moves in the internal channel of the pressure regulation valve in response to the flow amount of liquid passing through the first channel member, and the regulation amount of the second regulating portion varies with the moving of the movable member.

4. The image forming apparatus according to claim 3, wherein the movable member has a plurality of step portions of different diameters in a direction perpendicular to a direction in which the liquid flows and is housed in a free state in the internal channel of the pressure regulation valve.

5. The image forming apparatus according to claim 3, wherein the movable member has a sliding surface that slides along an inner wall of the internal channel of the pressure regulation valve.

6. The image forming apparatus according to claim 3, wherein the movable member defines a communication path system that communicates the first channel member and the third channel member.

7. The image forming apparatus according to claim 6, wherein the communication path system of the movable member comprises a plurality of pathways evenly distributed with respect to a circumferential direction of a face of the movable member disposed opposite the first channel member.

8. The image forming apparatus according to claim 3, wherein the movable member is pushed by a first liquid flow created by the liquid flowing from the third channel member into the pressure regulating valve in the same direction as a direction of a second liquid flow created toward the first channel member in the pressure regulation valve by liquid ejection from the nozzles of the recording head.

9. The image forming apparatus according to claim 8, wherein the movable member of the pressure regulation valve has a recessed portion, the third channel member has an outlet from which the liquid flows into the pressure regulation valve, and the recessed portion of the pressure regulation valve is disposed opposite the outlet of the third channel member.

10. The image forming apparatus according to claim 8, wherein the third channel member is tapered toward an outlet thereof from which liquid flows into the pressure regulation valve.

11. The image forming apparatus according to claim 8, wherein the third channel member has a plurality of outlets from which the liquid flows into the pressure regulation valve, the plurality of outlets substantially evenly distributed with respect to a circumferential direction of a face of the movable member disposed opposite the third channel member.

12. The image forming apparatus according to claim 8, wherein the movable member has a fourth channel member of substantially U-shape through which the liquid flowing from the third channel member into the pressure regulation valve is turned around.

13. The image forming apparatus according to claim 12, wherein a cross section of the fourth channel member gradually decreases from an inlet thereof toward an outlet thereof.

14. The image forming apparatus according to claim 3, wherein the movable member has a slanted face inclined with respect to a direction in which liquid flows from the third channel member into the pressure regulation valve.

15. The image forming apparatus according to claim 14, wherein the slanted face of the movable member includes a curved surface disposed opposite the third channel member to return the liquid flowing from the third channel member toward the second regulating portion.

16. The image forming apparatus according to claim 14, wherein the third channel member is tapered toward an outlet thereof from which liquid flows into the pressure regulation valve.

* * * * *